US006827120B2

(12) United States Patent
Last

(10) Patent No.: US 6,827,120 B2
(45) Date of Patent: Dec. 7, 2004

(54) AUTOMATIC POOL COVER SYSTEM USING BUOYANT-SLAT POOL COVERS

(76) Inventor: Harry J. Last, 1010 Koohoo Pl., Xailua, HI (US) 96734

( * ) Notice: Subject to any disclaimer, the term of this patent is extended or adjusted under 35 U.S.C. 154(b) by 109 days.

(21) Appl. No.: 09/829,801

(22) Filed: Apr. 10, 2001

(65) Prior Publication Data

US 2002/0046817 A1 Apr. 25, 2002

Related U.S. Application Data

(60) Provisional application No. 60/196,562, filed on Apr. 11, 2000.

(51) Int. Cl.[7] ..... E06B 9/08
(52) U.S. Cl. ..... 160/133; 160/311
(58) Field of Search ..... 160/133; 192/141; 4/498, 499, 502

(56) References Cited

U.S. PATENT DOCUMENTS 1,551,512 A * 8/1925 Goff ..... 200/47
3,613,126 A * 10/1971 Granderath ..... 4/502
3,718,215 A * 2/1973 Mimeur ..... 192/141
4,102,382 A * 7/1978 Vesbach ..... 160/188
4,203,174 A * 5/1980 Schults ..... 4/502
4,416,085 A * 11/1983 Lybecker et al. ..... 49/340
4,838,403 A * 6/1989 Layer ..... 192/141
5,913,613 A * 6/1999 Ragsdale et al. ..... 4/502

* cited by examiner

*Primary Examiner*—Blair M. Johnson
(74) *Attorney, Agent, or Firm*—Robert J. Schaap

(57) ABSTRACT

A drive and control system for controlling the movement of a pool cover comprised of interconnected rigid buoyant slats. The system relies upon a hydraulic drive section including a hydraulic motor drive which may be initially provided with fluid under pressure by a remote electric drive section. The hydraulic drive section is also provided with an effective means of controlling movement of the pool cover, both in a winding direction on a cover drum, which may be submerged, and/or in an unwinding direction where the pool cover is being unwound from the drum. Various mechanisms to control the movement of the cover are described herein.

41 Claims, 12 Drawing Sheets

CLASSIC ONE WAY CLUTCH MECHANISM

DRIVING

FREEWHEELING

AUTOMATIC POOL COVER SYSTEM USING BUOYANT-SLAT POOL COVERS

RELATED APPLICATION

This application is based on and claims priority from provisional application Ser. No. 60/196,562, filed Apr. 11, 2000, for Buoyant Slat Pool Cover Systems.

BACKGROUND OF THE INVENTION

1. Field of the Invention

This invention relates in general to certain new and useful improvements in automatic swimming pool cover system and, more particularly, to a cover system using a hydraulic drive for slatted buoyant type pool covers.

2. Brief Description of Related Art

Pool covers are used on many swimming pools. They save energy, keep the pool clean, minimize chemical use and provide desirable safety features. In fact, in windy locations, a pool cover is essential for maintaining pool water at comfortable temperatures at a reasonable expense.

The types of commercially available pool covering systems and those which have been proposed include free floating covers, tie down/stretched covers and track anchored floating covers. Mechanisms for retracting such covers back and forth across a pool include purely manual devices such as the "Rocky's" roller manufactured B. C. Leisure Ltd. 113-1305 Welch Street North Vancouver B.C. Canada V7P 1B3; semi-automatic systems (see U.S. Pat. No. 4,351,072) and automatic systems, which are usually electrically or hydraulically powered. (See U.S. Pat. Nos. 2,754,899; 2,958,083; 3,019,450; 3,050,743; 3,613,126; 3,982,286; 4,939,798 and 5,327,590).

Automatic swimming pool cover systems can include a flexible vinyl fabric sized so that most of it floats on the surface of the pool water. The pool water acts as a low friction surface significantly reducing the amount of force required to move the cover across the pool. The front edge of the cover is secured to a rigid boom spanning the width of the pool for holding the front edge of the cover above the water as it is drawn back and forth across the pool.

To draw the cover across the pool, a cable, typically a Dacron line, is incorporated into and forms a beaded tape which is sewn or attached to the side edges of the pool cover. The beaded tape in turn is captured and slides within a "C" channel of an extruded aluminum track. The track is secured either to the pool deck or to the underside of an overhanging coping along the sides of the swimming pool. The cables extending from the beaded tape sections of the cover are trained around pulleys at the distal ends of the tracks and return in a parallel "C" channel to the drive mechanism where they wind around cable take-up reels.

To uncover the pool, the drive mechanism rotates a cover drum mounted at one end of the pool winding the pool cover around its periphery and unwinding the cables from around the take-up reels. To cover the pool the drive mechanism rotatably drives the cable take-up reels, winding up the cables to pull the cover across the pool while unwinding the cover from around the cover drum.

The present applicant recognized the problems inherent in the use of an electric drive system for operating pool covers. Aside from the numerous safety factors, the electric motors had to be completely insulated from the water environment. Nevertheless, many pool cover drives are located in a subterranean environment. Consequently, the overall costs of construction and costs of installation were considerable.

Notwithstanding, even rain water and ground water tended to collect in subterranean compartments housing the electric motors and their associated electrical components. In fact, it has been recognized that at least fifty percent of the failures of most automatic pool cover systems is due to the inherent problem of water damage.

In order to overcome this problem, the present applicant had proposed and provided, as hereinafter described, pool cover systems which rely totally upon a hydraulic drive located at or near the swimming pool. An electric drive could be provided to operate a pump for pumping the hydraulic fluid. However, an electric drive and the pump could be located at a remote location and even housed in a building or the like.

In U.S. Pat. No. 5,184,357 issued Feb. 9, 1993, the present applicant describes automatic swimming pool cover systems wherein a first hydraulic drive provides torque for resisting cover drum rotation during cover extension and for rotating the cover drum for cover retraction. A separate and second hydraulic drive provides torque for rotating the cable reels for cover extension and for resisting cable reel rotation during cover retraction. In this latter U.S. Pat. No. 5,184,357, the desirability of having positive stops located at the respective ends of the pool is taught. These positive stops will stop movement of the rigid leading edge carrying the pool cover by increasing tension load on the cover and cables sufficiently for counter-balancing the torque of the particular driving hydraulic motor which is rotating either the cable reels or cover drum. These mechanisms need only be able to mechanically withstand the differential load of the driving hydraulic motor which rotates the cover drum and the opposing tension load imposed by the pumping hydraulic motor resisting rotation of the cover drum.

In under track systems (where the track is fastened to the underside of overhanging copings), the copings or walls at the respective ends of the pool can function as inherent stops arresting cover extension or retraction, provided however, that the rigid leading edge appropriately engages the coping or walls. Also, return pulleys at the distal ends of the respective tracks which carry the returning cables to the take-up reels, provide inherent positive stops for arresting extension of the cover. The pulley housings do not have "C" channels and hence will stop the sliders sliding within the "C" channels supporting the rigid leading edge carrying the cover across the pool. [See U.S. Pat. No. 4,939,798 issued Jul. 10, 1990 to applicant, Harry J. Last, entitled: "LEADING EDGE AND TRACK SLIDER SYSTEM FOR AN AUTOMATIC SWIMMING POLL COVER" and U.S. Pat. No. 4,466,144 issued Aug. 21, 1984 to Joe H. Lamb entitled: "PULLEY ASSEMBLY FOR SWIMMING POOL COVER"].

Automatic pool cover systems utilizing interconnected rigid buoyant slats which roll up on a submerged or elevated drum as described by U.S. Pat. No. 3,613,126, to R. Granderath, are popular in Europe. These pool cover systems utilize passive forces arising from buoyancy or gravity for propelling, the cover to extend the cover across a pool. With either buoyancy or gravity, there must be some mechanism to prevent a retracted cover from unwinding responsive to the passive force. Such passive force systems also have a disadvantage in that the passive force must be overcome during retraction. Granderath suggests a worm gear drive mechanism for winding the cover and preventing cover drum rotation when not powered. The slats for these are further described in U.S. Pat. No. 4,577,352, to Gautheron.

U.S. Pat. No. 4,411,031 to Stolar describes a system similar to Granderath where instead of rigid hinged buoyant slats, various floating sheet materials such as a polyethylene polybubble, or a laminate of vinyl sheeting and foamed substrate, are floated on the surface of the water. The propulsion of the cover across the pool is reliant on buoyant and gravitational forces much like the system in the Granderath patent.

Pool covers which employ floating slats or like materials, and which use buoyant forces to propel the cover across the pool, necessarily wind the cover onto a roller drum which is positioned below the water surface. When the cover is fully retracted from the swimming pool surface and fully wound onto the cover drum, the upper extremity of the complete cover and drum are at least two inches below the surface of the water cover in the pool. In some cases, the cover and drum are located in a separate water filled niche next to the pool. In other instances the cover and drum may be located near the bottom of the pool, or in a special hidden compartment underneath the pool floor to aesthetically hide the cover and roller drum, but also so that the mechanism does not interfere with swimmers.

Buoyant covers, which rely on buoyant or gravitational force to propel the cover across the pool, need to move at a low linear speed, and accordingly a low drum rotational speed, so as to prevent buckling of the cover as it moves across the water surface. A low rotational velocity is also necessary to prevent excess unwinding of the cover still wound onto the drum. In other words, there is a need to balance the resistive friction forces of the cover moving across the water surface against the upward buoyant forces inherent from the buoyant slats or sheeting material or the downward gravity forces where the roller is positioned above the water surface, as the fabric unwinds from the roller drum. The aforesaid Stolar patent recommends a rotational unwinding speed of the cover drum at 3.75 revolutions per minute for covers up to a 40 foot length.

The buoyant upward force resulting from the buoyance of the slats may be determined by taking the area of the cover freely submerged below the water surface, which is derived by multiplying the width of the cover by the amount of cover unwound from the cover drum, from the vertical distance as measured from the center of the diameter of the cover drum to the water surface, and multiplying this by the per square foot buoyant force of the cover material.

In the case of a cover where the drum is located at the pool bottom, the resultant buoyant force may be substantially in excess of the resistive forces. As a result, the roller drum may require a braking force to be applied in the unwinding direction to prevent the cover from unduly accelerating and also for the cover to maintain a cessation of movement at the end of designated travel without creeping, after the cover is at rest. Slats as described by Granderath and Gautheron are generally approximately 13 to 15 mm in thickness. Consequently, a pool cover about 40 feet in length when fully wound onto the cover drum will have a two foot diameter or more.

Most buoyant covers employ a drive system which incorporates a worm gear reducer in the drive train as taught by Granderath. Worm gear reducers generally of the single reduction type usually have a self-locking ability to prevent back driving of the output shaft, and thereby provide a controlled braking force against the buoyant forces tending to unwind the cover from the cover drum. It should be understood that in the case of covers mounted in the pool bottom and in particular, the combination of buoyant upward force and the resultant lever or moment arm from the cover drum diametrical buildup can result in high torque requirements on the motor drive system, adding considerable expense.

Automatic covers of the buoyant type described above typically locate the reducer and electric drive motor exterior the pool wall. The drive shaft of the cover drum passes through an orifice or opening in the pool side wall and incorporates a bearing and several seals and gaskets to prevent pool water from leaking or seeping from the pool around the drive shaft. Considerable expertise and skill is required to prepare and locate the bearing seal arrangement. Furthermore, a separate excavation and structure of sufficient size to house the drum shaft drive mechanism and to facilitate service is required next to the pool wall. In addition to the extra cost associated with the seals and water tight structure it is also very important to prevent rainwater or groundwater from accumulating or seeping into this structure and cause the electric motor and controls from being flooded and damaged. As with the American cable type automatic cover systems, it has been the experience with the European slat type cover systems, that as high as fifty percent of all automatic cover failure is attributable to moisture damage of the electrical drive and control system.

An alternative practice to the shaft-through-the-wall systems is the inclusion of the electric motor inside the cover drum. Typically the motor, for reasons of space limitations, must be coupled with a planetary gear arrangement to be able to substantially reduce the rotational speed required for these covers. Since planetary gears have no braking capability and will back drive, a friction brake must be incorporated inside of the drum, with adequate braking capability, adding to the expense. These arrangements are sold as waterproof systems, but there is little experience as to the durability and life of the seals of these systems and the manufacturers warranties are typically one to two years in duration. In the case of leakage, damage and the replacement labor cost of these systems is expected to be extensive.

Another concern and disadvantage of electrically powered cover systems is the risk of electrical shock hazard. In many U.S. jurisdictions there are strict requirements for bonding and location of the electrical motors near the pool, and in many parts of Europe voltages in excess of 40 volts are not allowed within ten feet of the pool water surface. In the case of systems where the electric drive motor is in the tube there will also be a shock hazard when the enclosure leaks and floods the motor. A problem with low voltages is that the current carrying capacity is low and therefore for long distances away from the pool the cable thickness requirements will be high, expensive and impractical.

Covers using a flexible membrane and side tracks which are pulled open and closed with a cable mechanism, are generally faster, with a cycle time of 30 to 45 seconds. For safety reasons these systems employ a momentary contact switch which the operator must hold and operate for the full cycle of cover travel. Since the primary reason of these safety covers is to prevent entry into the pool, the cover will also trap the swimmer if caught beneath a closed cover. Consequently safety regulations generally mandate the momentary switch to force the cover operator to stay at the control switch while the cover is moving. When the cover reaches the end of travel, the operator simply releases the switch and the cover stops. Because it is often difficult for the operator to precisely see when to stop the cover movement, various forms of electric limit switches and sensors are used to precisely stop the cover automatically.

On cable and side track type of safety covers, coupling of the electric drive gear motor to the cover drive drum and the cable reel is usually by means of a clutch as described in various patents by Lamb and McDonald. This means that rotary revolution counting limit switches, such as described in U.S. Pat. No. 3,718,215, coupled to the gear motor shaft, are usually inaccurate and unreliable. Consequently sensor type limit switches employing the attachment of sensors or magnets to the cover fabric are often used. Also extensive use of electrical control wires is necessary from the sensors to the control switch. Because covers stretch, accumulate dirt and debris, electric control wires snag and break. Also over time sensors dislodge. As a result this type of limit switch is often very unreliable.

A more reliable type of means of stopping the cover at the end of travel is described in U.S. Pat. No. 5,184,357. In this case, with the hydraulically powered pool covers, hydraulic pressure relief valves are often used to stop the cover automatically as the leading edge slider reaches an end of travel. A further patent by the applicant provides a split stop, in which the leading edge slider, sliding in the cover track extrusion, is stopped at the end position by the track end pulley bracket and at the other end by the track split stop. Another means of stopping the cover is described by McDonald using a separate cabling system and electric limit switches activated by stops attached to the cable. A further method is described in U.S. Pat. No. 5,920,922 where the low stretch pulling cable with stopping device attached is used to limit travel of the cover.

Slat type or other buoyant covers which rely on buoyant or gravitational force may take as long as three minutes to cover the pool. Since these covers are generally not classified as safety covers and are generally not secured to the sides of the pool, they can usually be lifted upward to allow a swimmer to get out from under the cover. These covers usually use a latching type of switch which will keep the cover running in one direction and which does not require the operator to stay with the control. The latching type of control however, must have a means of stopping the cover automatically at the end of travel to prevent damage to the system.

As with the cable type pool covers, slat covers will sometimes use sensor type of limit switches and generally experience the same problems with the environment as described above. Since the cover drum is generally directly coupled to the motor drive shaft, rotary limit switch devices as described in U.S. Pat. No. 3,718,215 are reasonably effective. A more recent means is the use of electrical rotary encoders to count rotations of the drive shaft and send an electrical signal to the control system or motor drive. As with the electric drive motors it is important to keep moisture away from these controls to keep them functioning reliably. As described above, this is typically a problem in a swimming pool environment.

Mechanisms for controlling movement of slat type members and other screw drive members and, particularly, to provide limit stops have also been widely used in the aircraft industry. However, these devices are concerned primarily with high speed operation and low torque operation. Exemplary is U.S. Pat. No. 4,930,611 to Grimm and U.S. Pat. No. 4,838,403 to Layer.

BRIEF SUMMARY OF THE INVENTION

A desirable solution for the buoyant slat type, buoyant membrane or even the gravity type of cover, would be to use a hydraulic motor drive system to move the pool cover drum and thereby alleviate the moisture problems, flooding and electrical shock hazard associated with electric pool cover drive systems. The advantage of hydraulic systems is that the power pack pump system can be placed some safe distance away from the pool and in a covered building area. Only two hydraulic lines are required to power the cover system. Little use has been made of hydraulic motors in the buoyant type of cover to date because of the following problems.

One problem with the slat cover, is that there is a constant buoyant force or a gravity force on the cover in the covering direction. One solution that is typically used in similar hydraulic applications, where the hydraulic motor is subject to over-running, is to provide for a counterbalance hydraulic valve or alternatively a brake valve on the output or exhaust port of the hydraulic motor. These counterbalance hydraulic valves include normally closed valves which are opened only when a preset pilot pressure is reached. This pilot pressure source is typically from the outlet pressure of the motor. Hence the motor will not turn until there is enough resistance or braking built up before the valve opens and allows fluid to flow out of the outlet port of the motor and the shaft to turn. This braking effect is maintained throughout the cycle. A brake valve is similar in operation of the pilot valve, but incorporates a second pilot line and is a complicated valve with additional benefits.

Although these brake valves and pilot valves can act as forms of check valves, they will not maintain a motor in a locked condition. This is because unlike a direct brake on a drive shaft, there is an indirect fluid connection. Although the hydraulic motor can prevent rotation better than electric motors by blocking fluid flow on the inlet and outlet ports, there is still enough internal leakage in the motor to cause some creep of the motor shaft when subjected to constant load at rest, such as the torque on the shaft from the buoyant force or gravitational force of a floating pool cover. Slight movement of the motor shaft may occur over time with the shaft under buoyant torque at rest, and consequent movement of the cover. Consequently for applications such as cable winches, positive braking to the output motor shaft must be applied to maintain a safe locked condition. As a result, either a more expensive hydraulic brake motor with additional control systems must be used, or the motor must be coupled with an additional cost worm gear reducer to provide braking, as used with the electric drive motors.

Unlike electric motors, where a gear box with a high gear reduction is necessary to develop the high torque and low shaft speed at the cover drum drive shaft, High Torque Low Speed (LSHT) hydraulic motors can easily run at 4–5 revolutions per minute and at high torque. Adding a worm gear reducer, for braking only, can add considerably to the cost of the drive system. Furthermore, for the reducer to act as a brake it must also possess high internal frictional resistance and must be inefficient. A practical gear ratio of such a worm gear reducer is 20:1. This means that the hydraulic motor must be made to run 20 times faster than if it were directly connected to the drive shaft. This further means that the pump must also put out a substantially higher volume of fluid, which generally increases the cost of the power pack.

A gear reducer in combination with a hydraulic motor actually functions as a direct drive component. Moreover, it becomes a rather costly component to serve as a brake when, indeed, it is not highly efficient for providing braking power. Inasmuch as the gear reducer must be in the gear train, the size of this gear reducer must conform to the torque requirements. Where the torque requirements are high, the size of the gear reducer must be large. Thus, the gear reducer can become a very costly component and merely function as a brake. Consequently, use of the reducer is highly inefficient.

Hydraulic motor systems can easily be fitted with electric rotary limit switches or rotary encoders as described above.

These systems can be directly coupled to the drive shaft because the cover is directly coupled. This however requires running electrical control cabling with inherent shock hazard at the pool. Also moisture problems as described above will negate the advantage and reliability of using the hydraulic drive motor. Since there is not a cable pulling the cover to a closed position, the cover cannot be used as a positive stopping means to activate a hydraulic pressure relief valve.

Various types of travel limiting devices are described in a number of U.S. Patents. The aforesaid U.S. Pat. No. 4,838,403 to Layer. In effect, Layer is using a snubber valve to achieve an over-travel stop activated control system. The present invention employs a valve to shut off fluid flow. In effect, fluid flow is blocked to trigger a pressure switch and thereby actuate a latching relay. In contrast, the system in the Layer patent relies upon the braking of a motor from an opposite direction.

Another travel limiting device is described in U.S. Pat. No. 4,064,981 by House and Pierik. This patent describes a shock absorbing feature using a traveling nut on a threaded shaft device to limit the revolutions of a drive shaft on airplane flap actuators. This device is used as a backup in case of failure of the electrical limit systems. The device described is designed specifically to take high speed high torque loads. This device is also complex in construction and uses a two part traveling nut with a pair of concentric jack screws to prevent jamming of this high speed high torque device. In effect, this mechanism is designed for aircraft safety.

The present invention provides for a floating pool cover drive system and cover travel limiting system which overcomes the drawbacks associated with prior floating pool cover systems, while obtaining additional advantages of safety, reliability, lower cost and easier installation.

One object of this invention is therefore to provide a means to control the flow of fluid under pressure to the hydraulic motor to limit the travel of the cover. Another object is to enable using a hydraulic motor to drive the cover system without the use of a worm gear reducer as an unwinding braking force.

In order to avoid and overcome the above problems, the present invention provides for a very simple floating cover drive system which overcomes many of the drawbacks with prior floating cover drive systems while obtaining additional advantages and benefits including lower cost, lower construction and installations costs as well as significantly improving the reliability and also the appearance of such systems. This system is also applicable to both hydraulic and electrical cover drives.

This invention possesses many other advantages and has other purposes which may be made more clearly apparent from a consideration of the forms in which it may be embodied. These forms are shown in the drawings forming a part of and accompanying the present specification. They are also described in more detail in the following detailed of the description of the invention. However, it is to be understood that this following detailed description and the accompanying drawings are set forth only for purposes of illustrating the general principles of the invention and are not to be taken in a limiting sense.

BRIEF DESCRIPTION OF THE DRAWINGS

Figure 1:
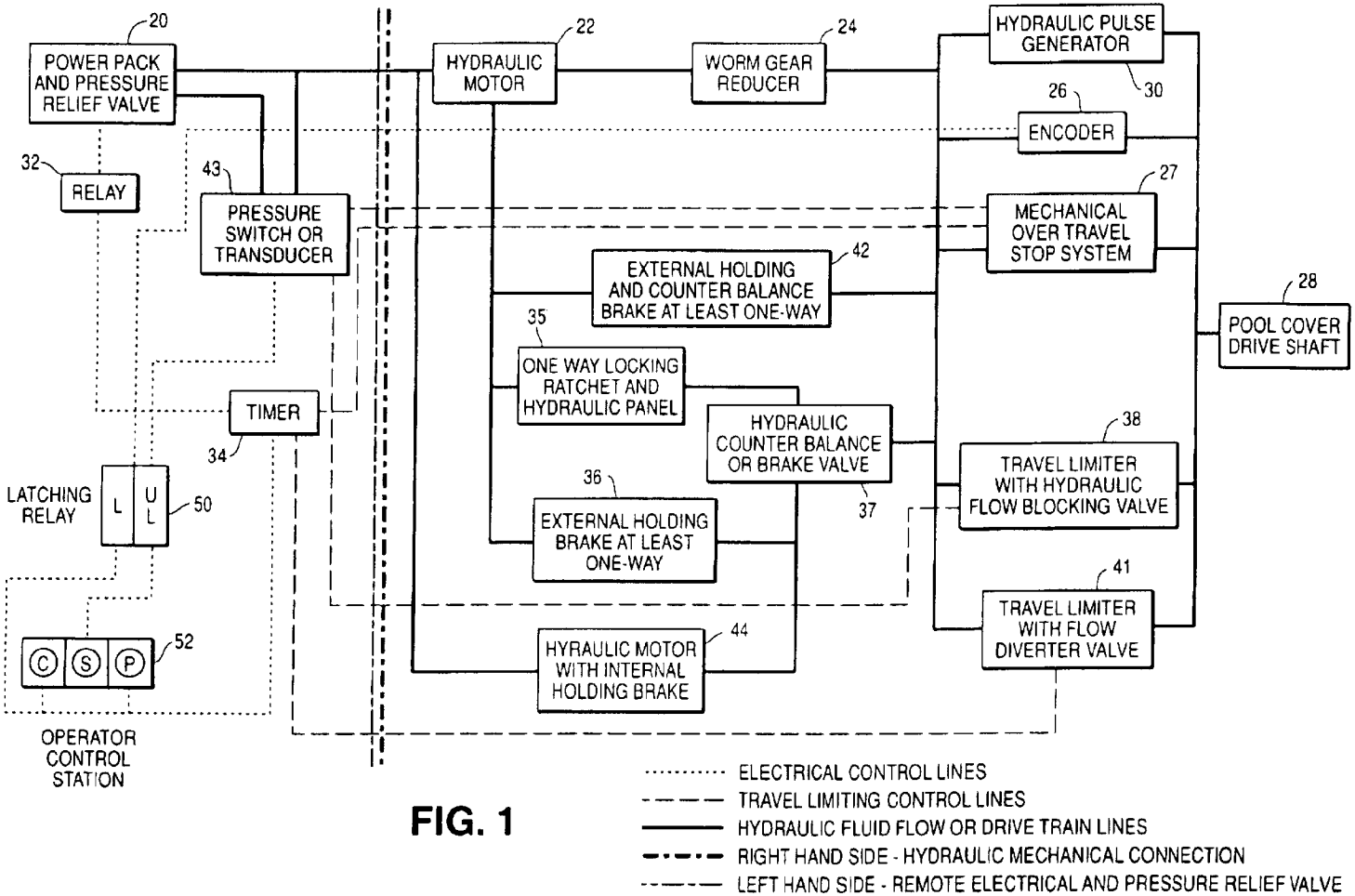
Figure 2:
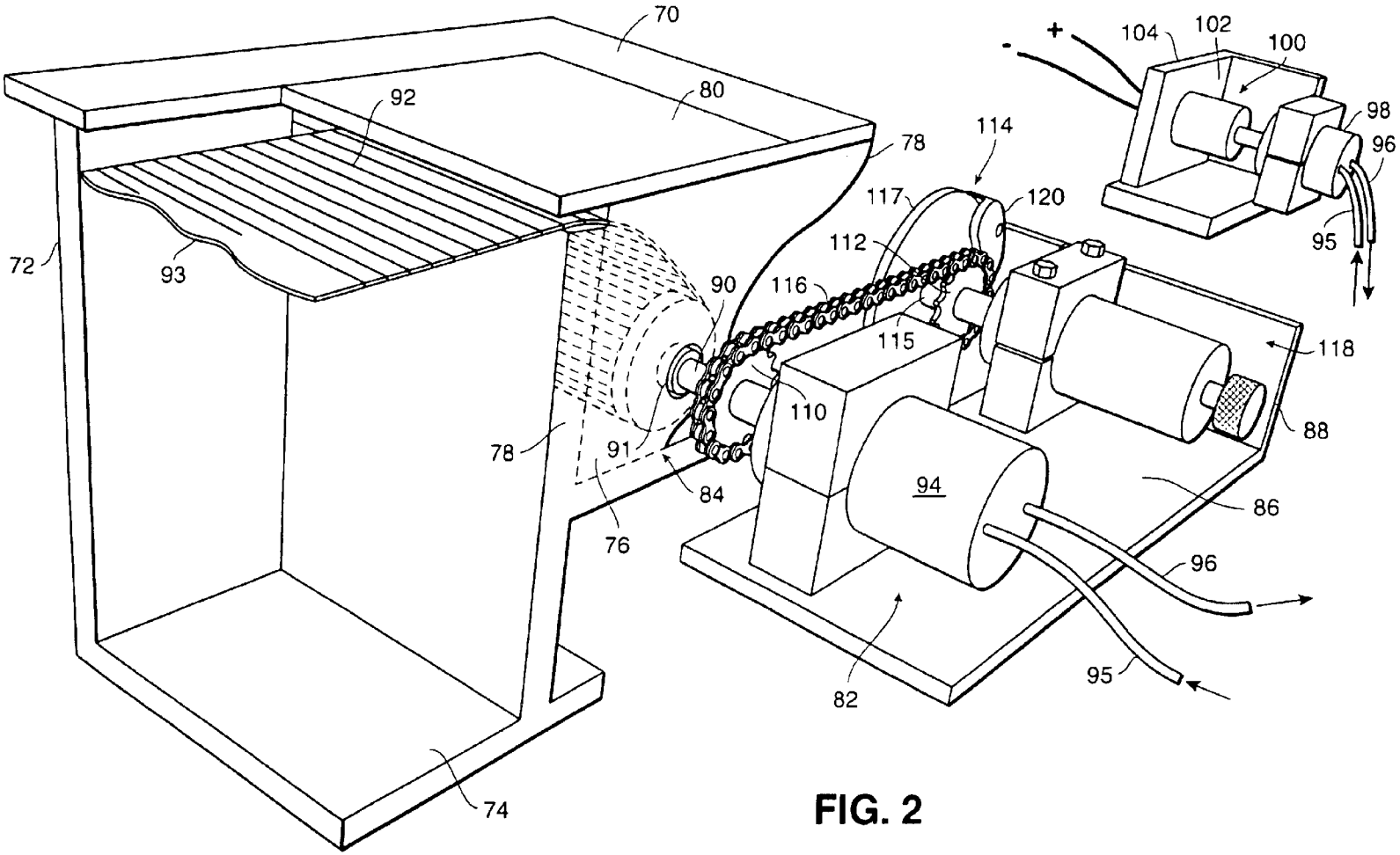
Figure 3:
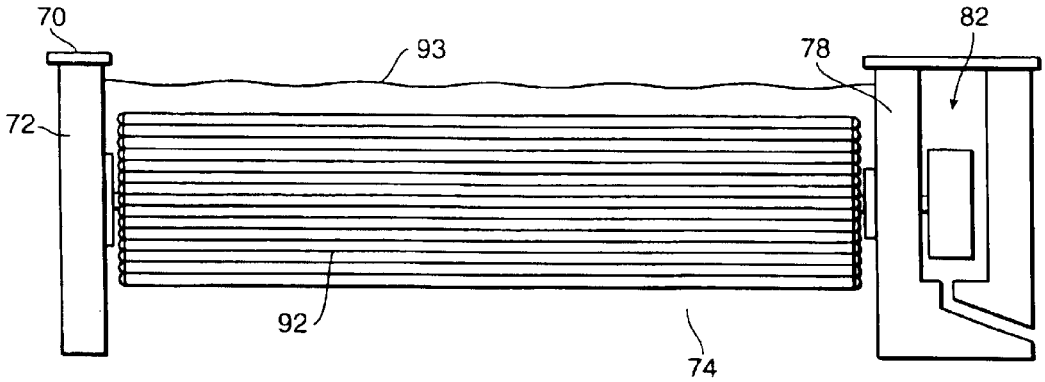
Figure 4:
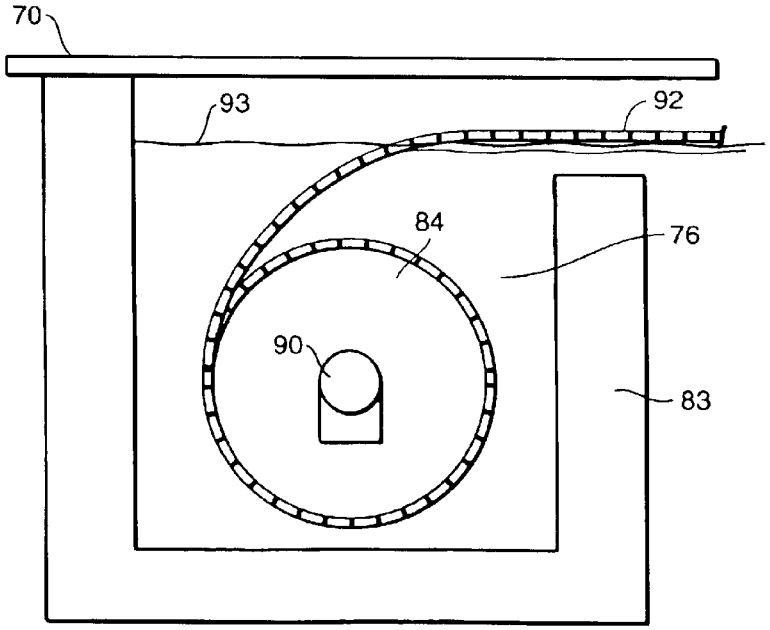
Figure 5:
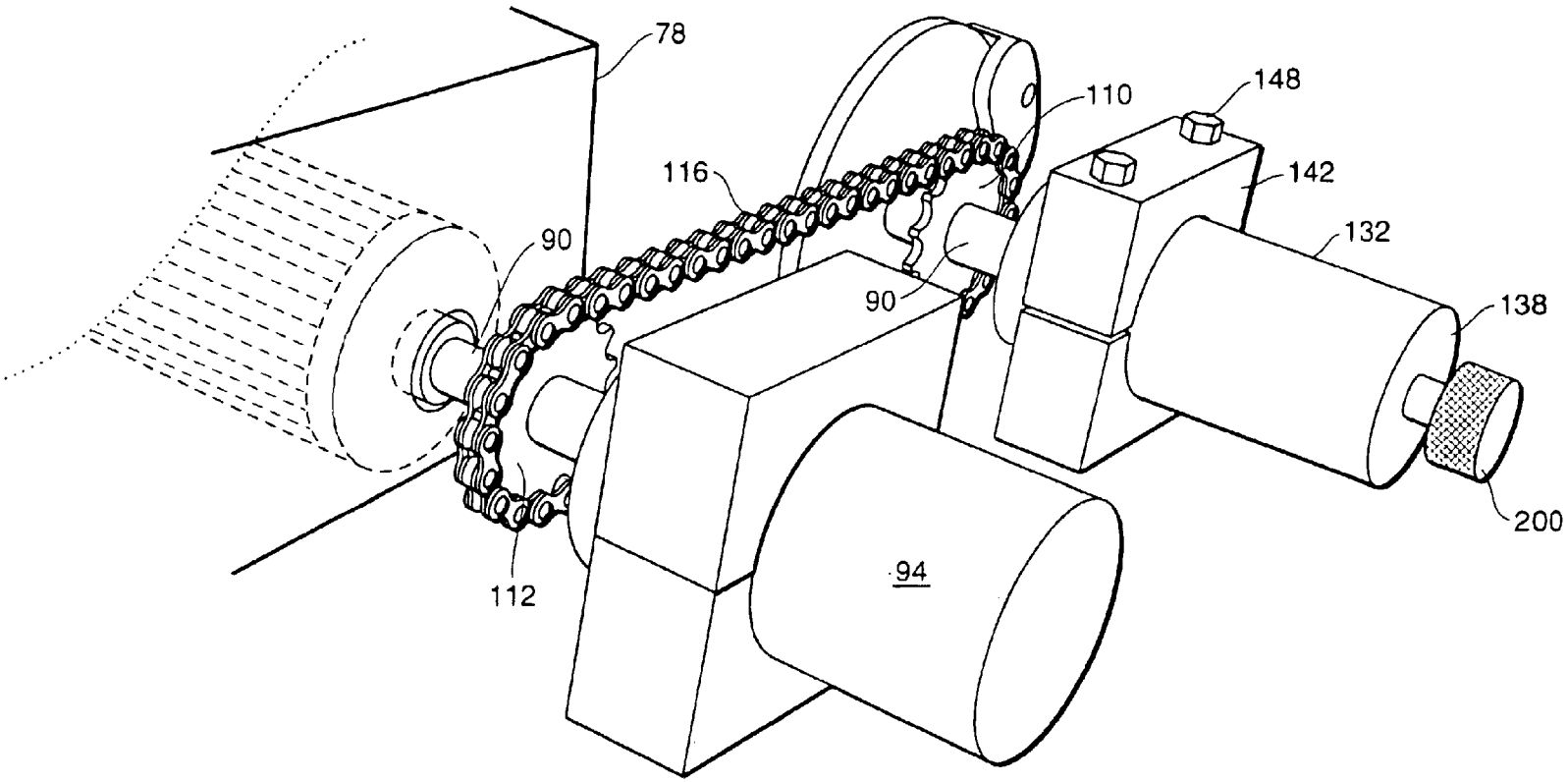
Figure 6:
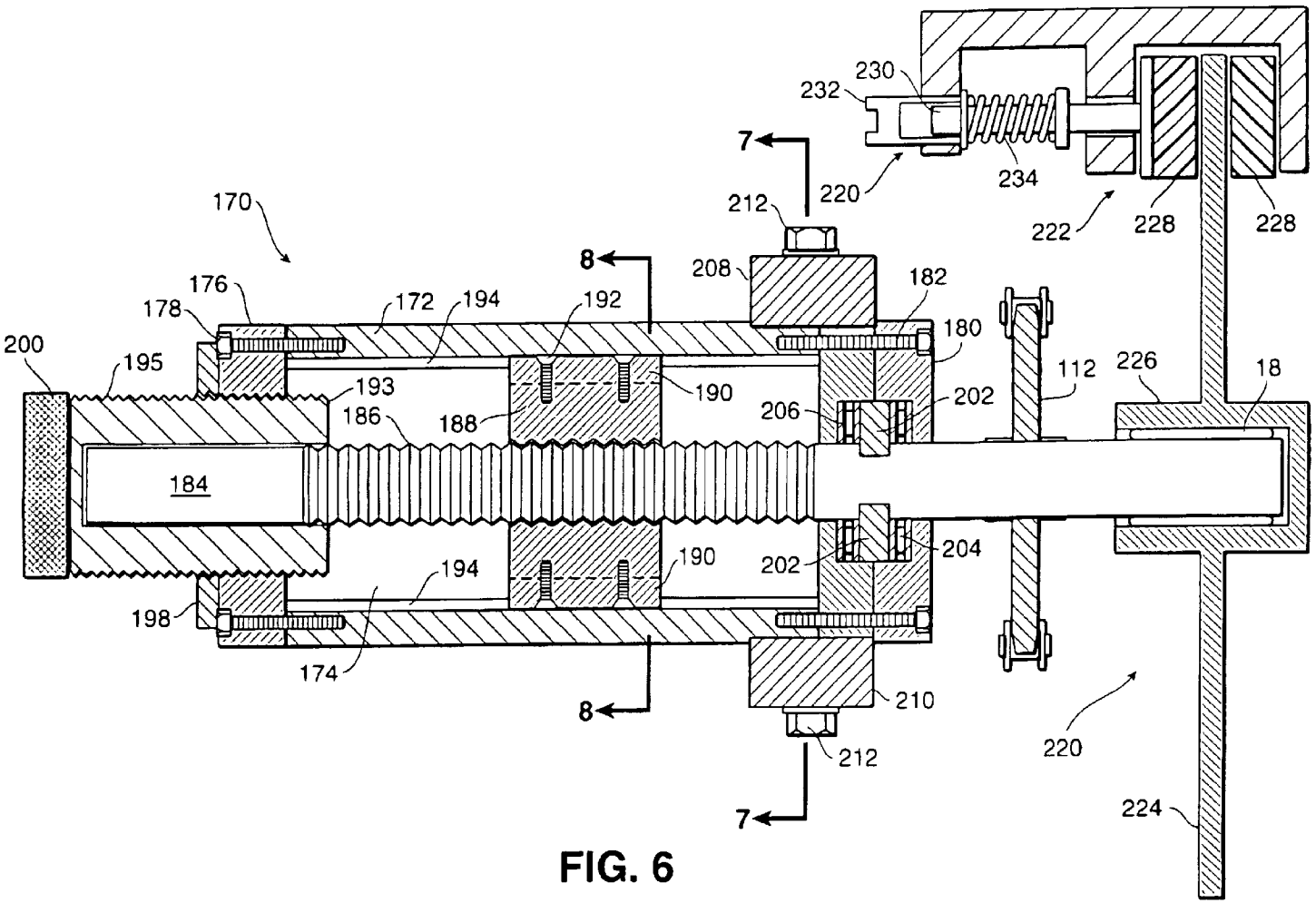
Figure 7:
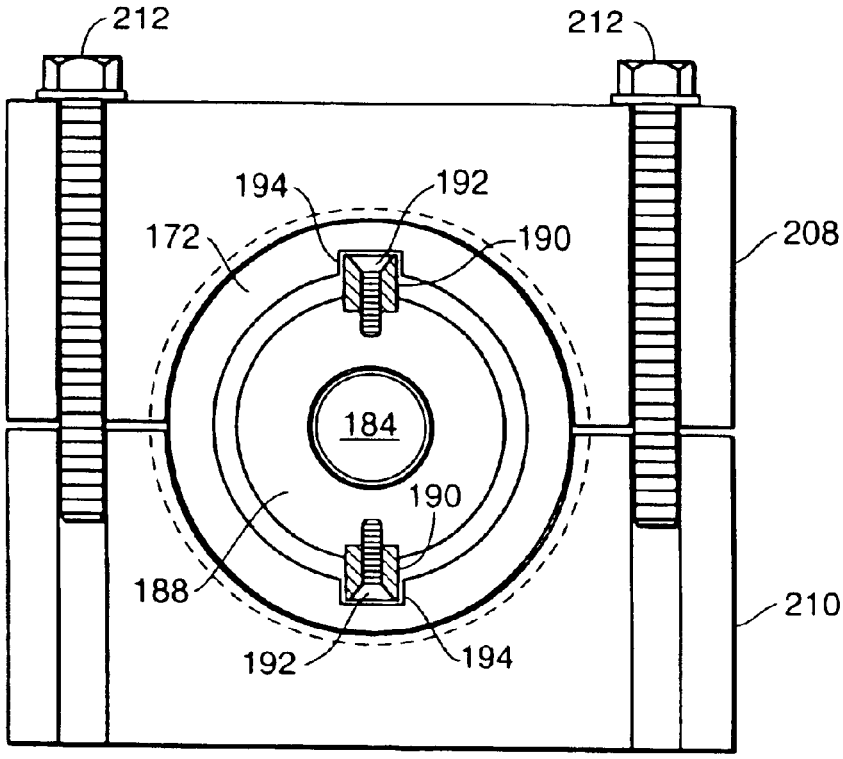
Figure 8:
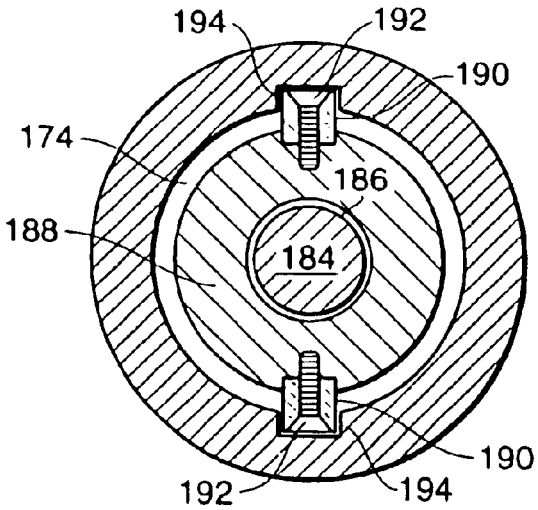
Figure 9:
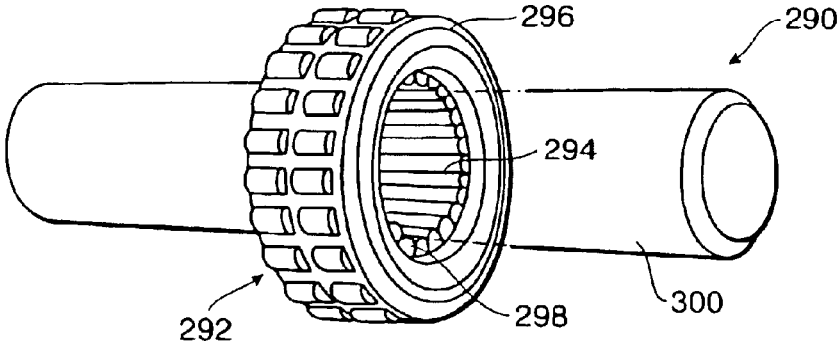
Figure 10:
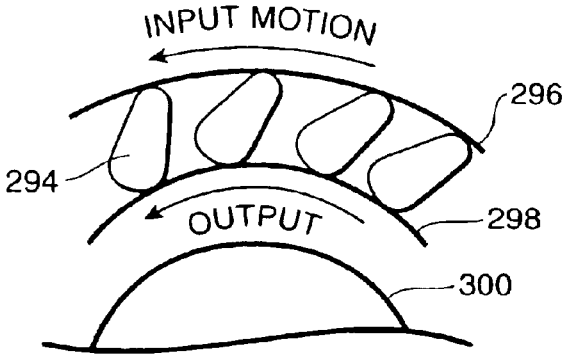
Figure 11:
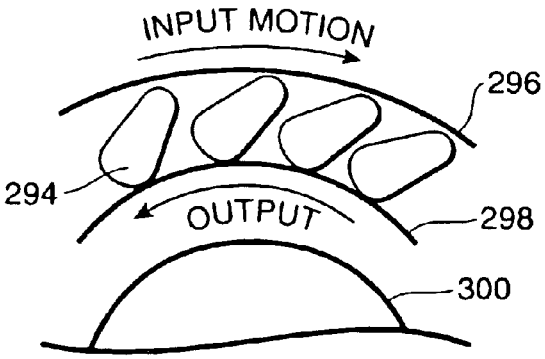
Figure 12:
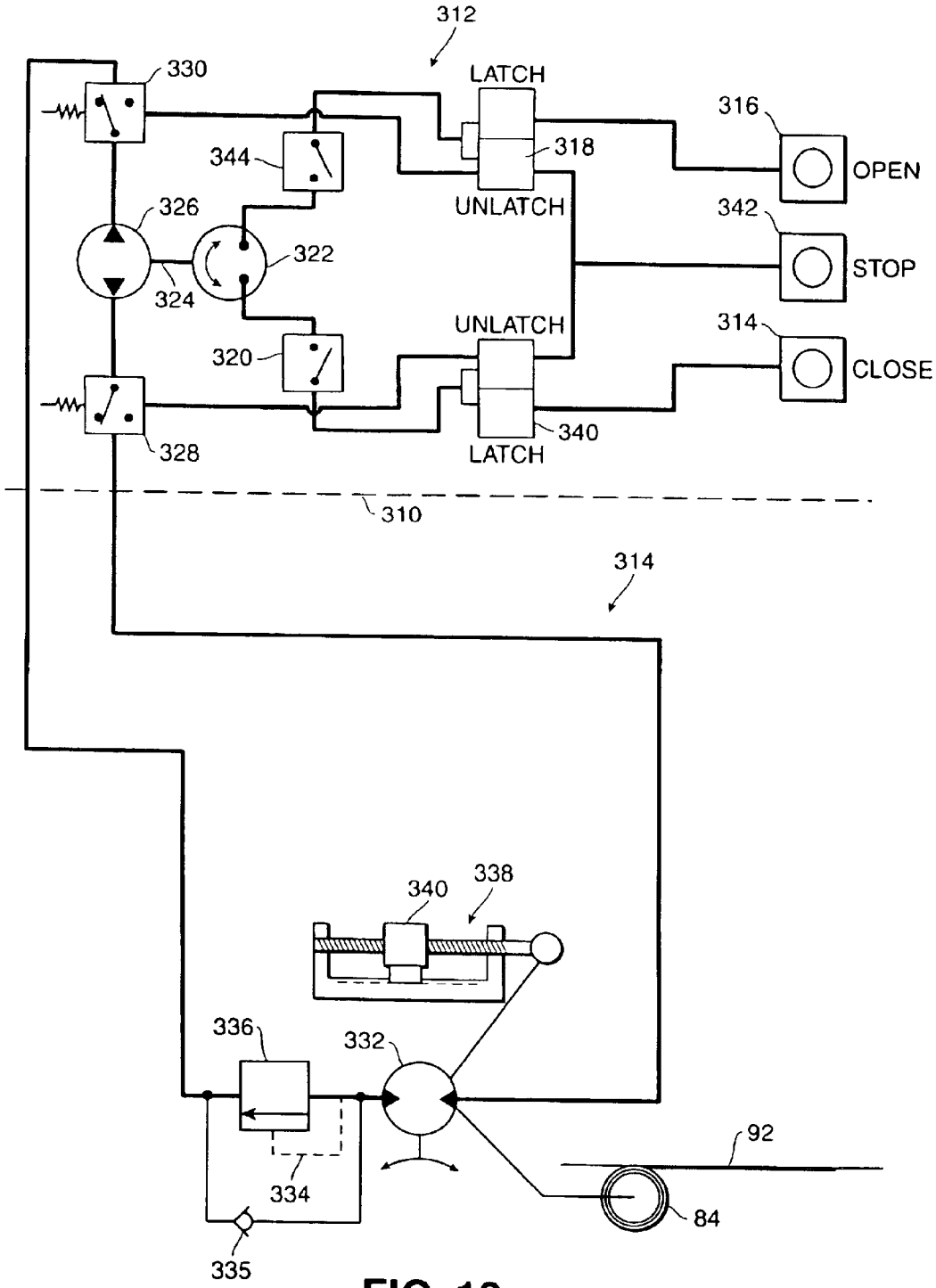
Figure 13:
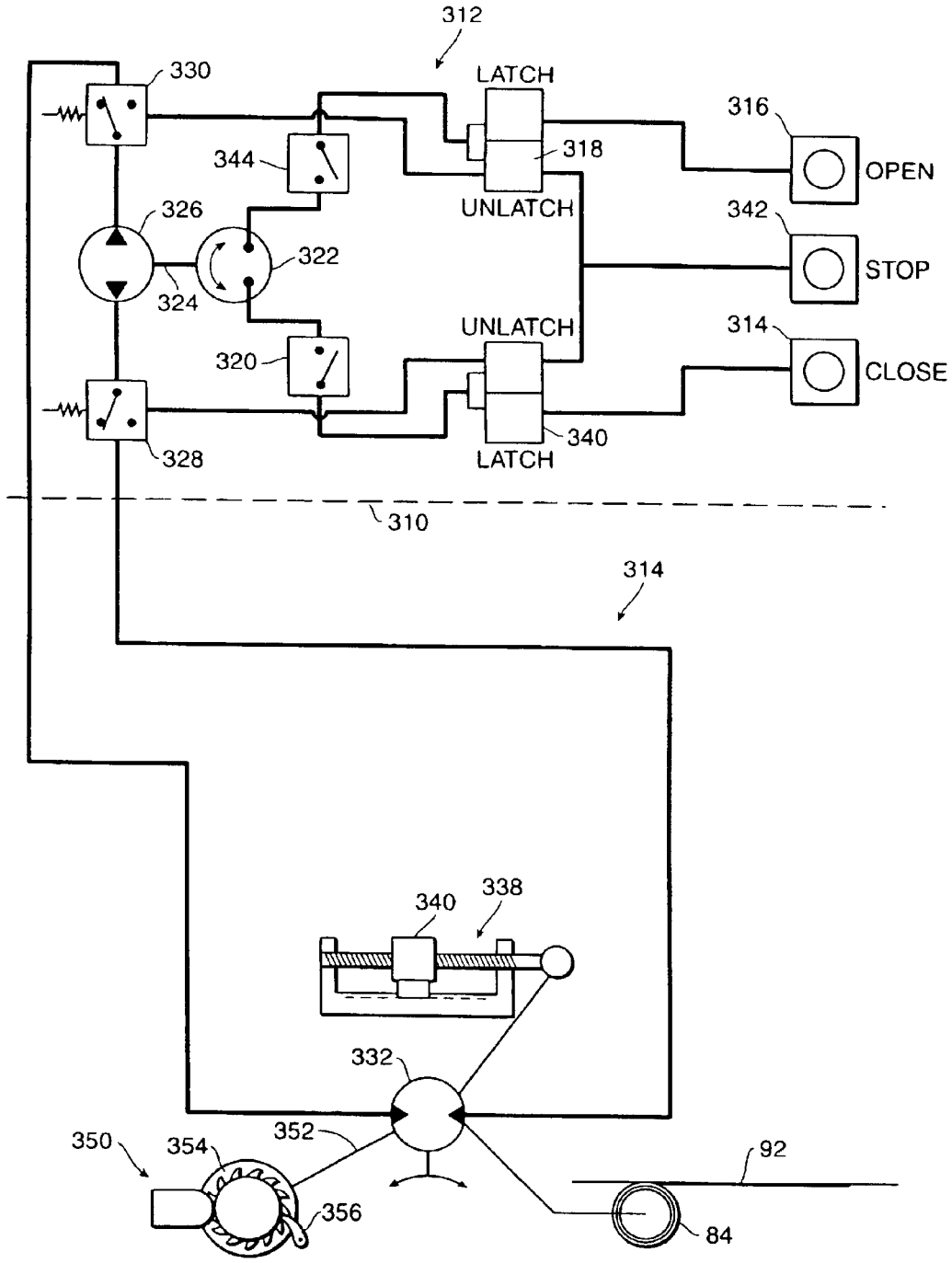
Figure 14:
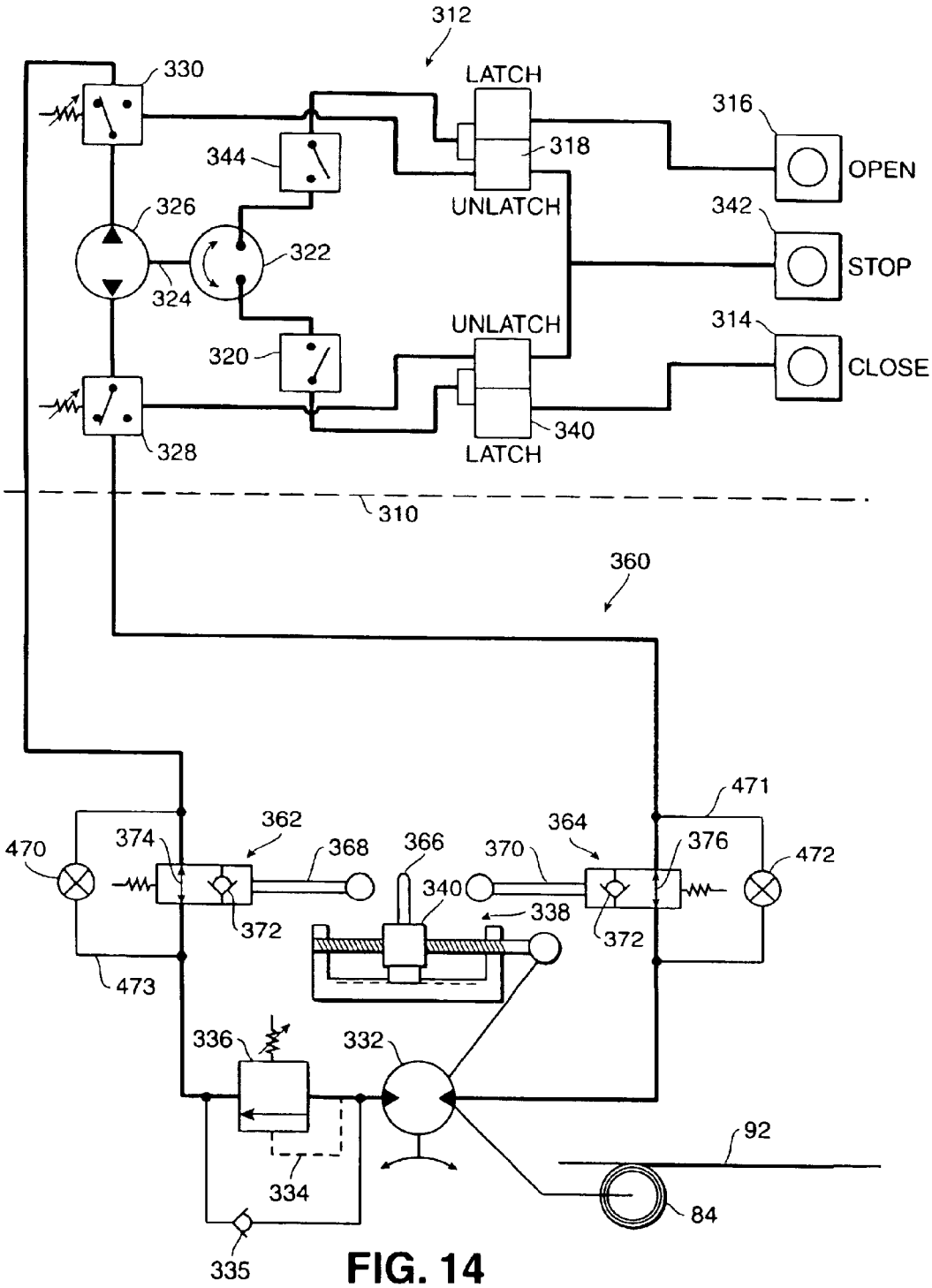
Figure 18:
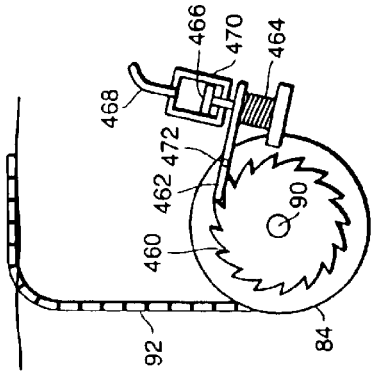
Figure 15:
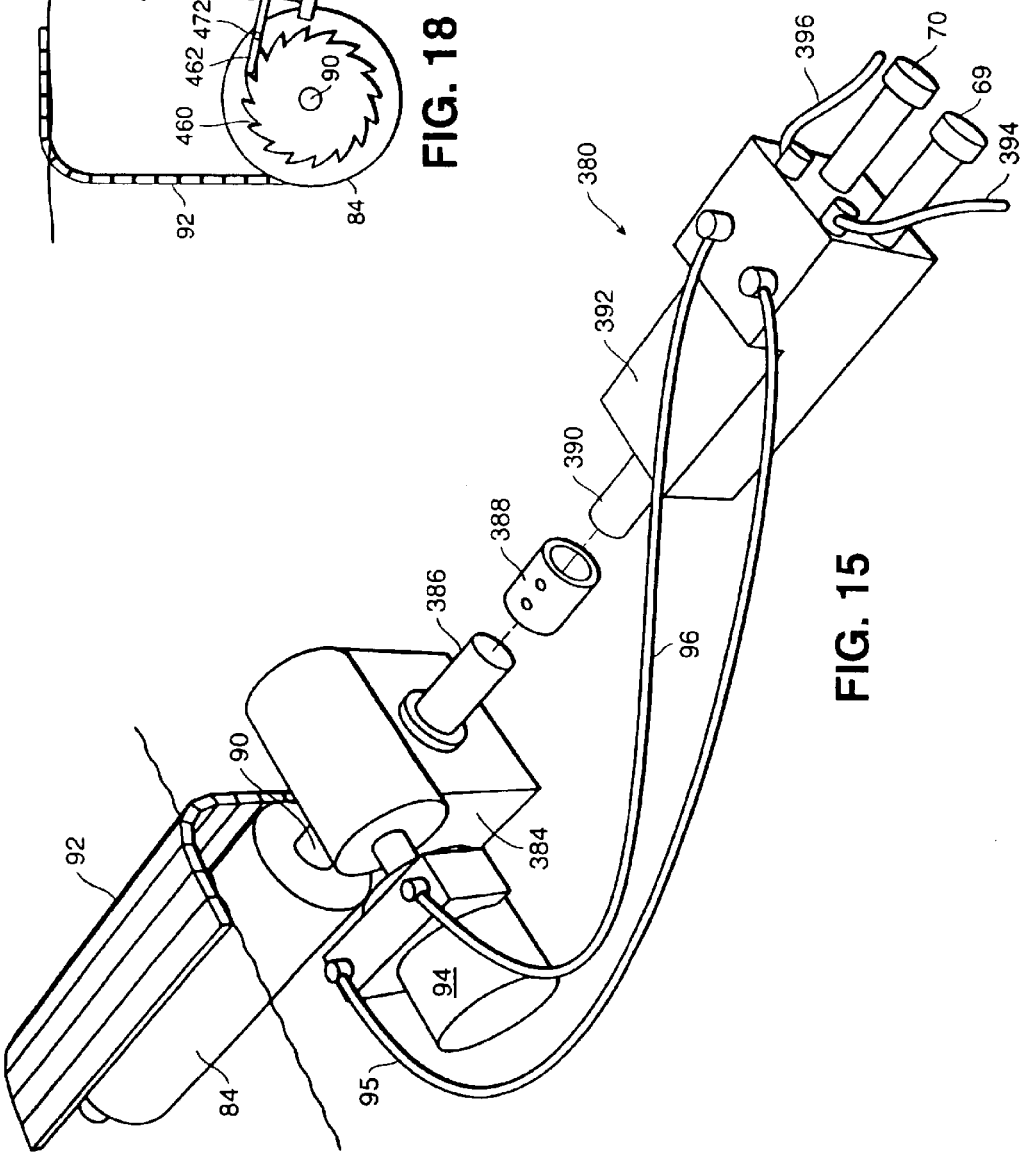
Figure 16:
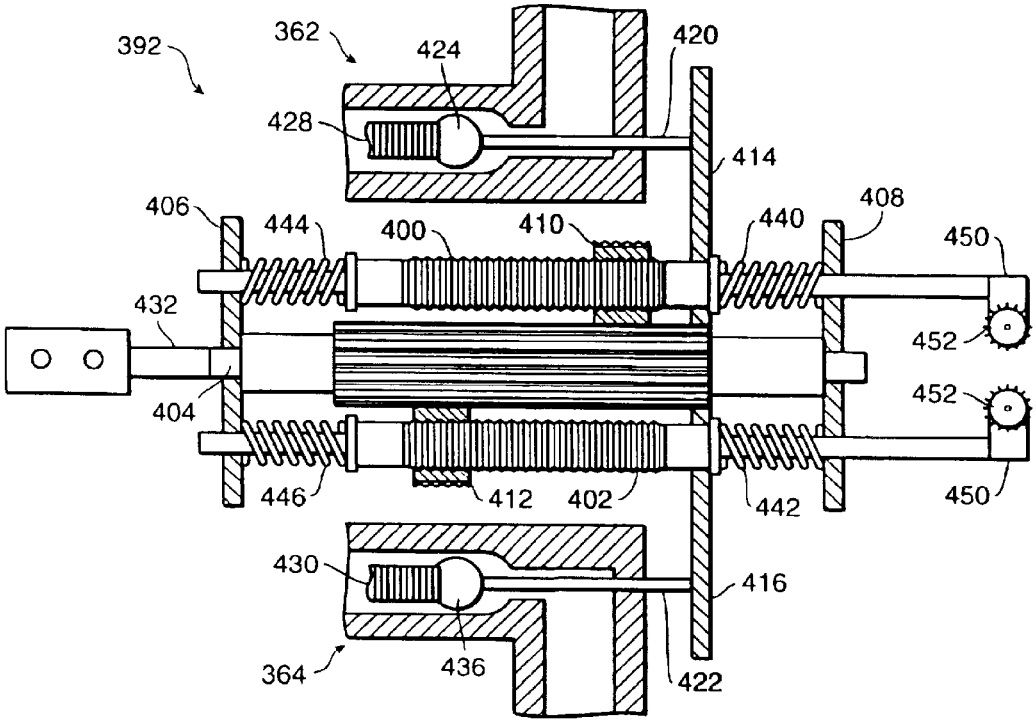
Figure 17:
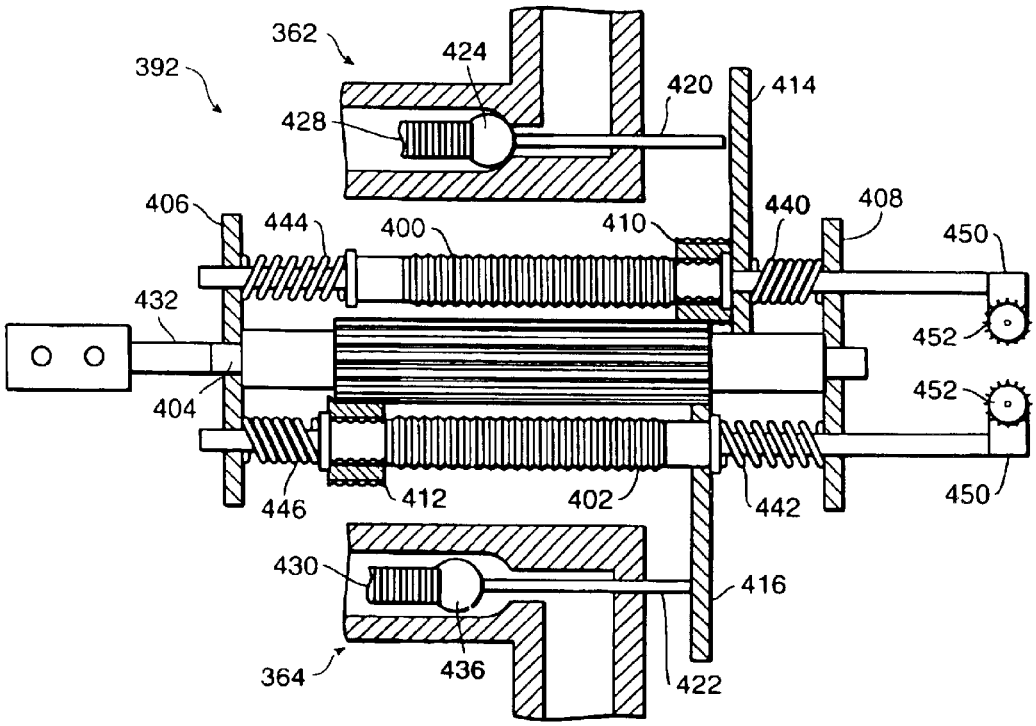

Having thus described the invention in general terms, reference will now be made to the accompanying drawings in which:

FIG. 1 represents a flow diagram which shows possible combinations of components forming part of various gravity/buoyant slat-membrane pool cover systems;

FIG. 2 is a somewhat schematic fragmentary exploded perspective view of one form of hydraulic drive operated pool cover system forming part of the present invention;

FIG. 3 is a side elevational view of an arrangement for mounting a pool cover in a submerged position and the associated drive mechanism associated therewith;

FIG. 4 is a schematic side elevational view showing the arrangement of the pool cover of FIG. 3 in a submerged position;

FIG. 5 is a fragmentary perspective view, partially broken away and in section, showing the operative arrangement of a travel limiting control mechanism with a pool cover drum forming part of the automatic pool cover system of the invention;

FIG. 6 is a vertical sectional view showing one form of travel limiting control mechanism for use with the present invention;

FIG. 7 is a sectional view taken along line 7—7 of FIG. 6;

FIG. 8 is a sectional view taken along line 8—8 of FIG. 6;

FIG. 9 is a schematic perspective view showing a one way clutch mechanism which may used in the control system of the present invention;

FIG. 10 is a fragmentary schematic side elevational view showing a cam-wedging arrangement for controlling unwinding of a cover from a cover drum;

FIG. 11 is a fragmentary schematic side elevational view, similar to FIG. 10, and showing the cams forming part of the arrangement of FIG. 10 in a different position;

FIG. 12 is a schematic view showing one form of fluid drive control system for use in the present invention;

FIG. 13 is a schematic view showing an alternate form of fluid drive control system for use in the present invention;

FIG. 14 is a schematic view showing still a further form of fluid drive control system for use in the present invention;

FIG. 15 is a schematic perspective view of a further modified form of automatic cover drive system which can be used in accordance with the present invention;

FIG. 16 is a schematic side elevational view of a mechanical limit switch actuator used with the control circuit of FIG. 15 and showing the actuator in one position;

FIG. 17 is a schematic side elevational view, similar to FIG. 16, and showing the mechanical limit switch actuator in an alternate position; and FIG. 18 is a fragmentary schematic side elevational view showing another modified form of travel limiting device using a type of one way clutch mechanism in place of a hydraulic motor with a holding brake.

OVERALL SYSTEM COMBINATIONS

Referring now more particularly to FIG. 1, there is schematically illustrated various combinations of components which form various embodiments of the present invention. By referring to FIG. 1, some of the major components which can be used in various combinations are schematically identified. Initially, it can be observed that there is provided a floating cover with slats moved by the buoyant force, that is, the force imposed on a submerged cover drum which tends to force the slats upwardly to thereby unwind from the drum. In effect, some means must be provided to control that movement for the cover slats when the cover is moving to the fully covered position or closed position.

Also referring to FIG. 1, it can be observed that the cover may be a floating cover with the slats moved by a gravitational force. In order to control this movement, some of the components which are provided includes a hydraulic motor which allows winding of the cover on the drum by powering the drum for rotation. A brake built into the drive system, or otherwise separately provided, can be used to control any unwinding.

In order to preclude a buckling of the cover when abutting against the edge of a swimming pool during an unwinding, a travel limiting control means is provided to stop cover movement. One form of travel limiting control means may be a hard stop travel limiter, as described herein. Somewhat related devices also exist in the prior art but not with buoyant slat cover systems.

A major component of the system of the present invention is preferably a hydraulic motor. Moreover, a hydraulic motor with an internal brake may also be employed. This can be effective because a brake on the motor shaft can be used to reduce any problems of slippage of the hydraulic motor. A holding brake can prevent rotation of the drive shaft and can also be provided with a counter balance circuit to provide counter balance force.

An electric motor drive could be used for winding the cover onto the drum. However, the hydraulic motor system is preferable inasmuch as it eliminates the hazards associated with electrical power in close proximity to a swimming pool.

In order to control end point movements of the cover, that is, to cause the cover to stop movement at one end of the swimming pool when moving to the closed position and in order to stop movement of the cover when it is fully wound upon the drum, a rotary encoder limit switch or an electrical limit switch could be used. Furthermore, a worm gear drive coupled to a motor or drum shaft could be incorporated to control end points of travel.

In contrast, a braking means effectively serves the function to stop movement of a cover. The braking means could operate as a type of rate movement mechanism to control the rate of movement of the cover, whereas the travel limiting means will stop the movement of the cover at specific end points. Various types of devices can be used for this purpose and including a hydraulic pump with an adjustable pressure transducer. Open and closing control switches can be used. In addition, a hydraulic counter balance valve can also be employed for this purpose. Other components which can be used to provide the braking action and to provide a limit of travel are also disclosed in FIG. 1 of the drawings.

In addition to the foregoing, other embodiments to control limits of movement include a hydraulic pump with an adjustable pressure switch or transducer switch generating a signal to break electrical power.

Referring now in more detail to FIG. 1, it can be seen that there is initially an electric power pack 20 which includes, for example, an electric motor, and which may be used for operating a hydraulic system, a main component of which is a hydraulic motor 22. In this case, the hydraulic motor 22 and the associated components, with the exception of the power pack 20, could be located in close proximity to a swimming pool since they are all hydraulically operated. The electric power pack 20 would be located at a remote position with respect to the hydraulic motor and connected to that hydraulic motor.

A simple drive system which uses a hydraulic motor 22 in combination with the power pack 20 would employ a worm gear reducer 24 on the output of the hydraulic motor in order to control buoyant forces which tend to unwind a cover from the cover drum. In order to preclude hard impact of the cover or buckling of a cover at an end of travel position, either when opening and, particularly, when closing, encoders of the type described above can be used including, for example, a rotary shaft encoder. A rotary shaft encoder 26 could be connected directly to a pool cover drive shaft 28, as schematically shown in FIG. 1. In accordance with this system, the main electrical component, such as the power pack, would be in a position remote from the swimming pool. The hydraulic motor 22 could be located at or in close proximity to the drum shaft for the pool cover. The only electrical component at or near the swimming pool would be the encoder 26. However, the encoder could be designed to operate with very low current levels to minimize any electrical hazard.

The power pack 20 could also be operated with a pressure relief valve. Moreover, the power pack 20 operates in conjunction with a relay 32 and a number of other components, as illustrated in FIG. 1. As an example, the relay 32 would operate in conjunction with a timer 34 and a mechanical over travel stop system 27, in turn, connected to the pool cover drive shaft 28.

The power pack 20 and the hydraulic motor 22 could also operate with an external holding brake 36 constituting at least a one way brake action, and which would, in turn, operate with a hydraulic counter balance or brake valve 37. However, some travel limiting mechanism of the type described herein would necessarily have to be employed. This travel limiting mechanism could be the mechanical over travel stop system 27, or otherwise a travel limiter 38 with a hydraulic flow blocking valve, or otherwise a travel limiter with a flow diverter valve 41 used at the output of the hydraulic counter balance and brake valve 37. It can be observed that this system can rely upon a positive pressure switch 43 to shut down a pump operating with the power pack 20 or, alternatively, rely upon the pressure relief valve forming part of the power pack 20 to bypass pressurized flow to a sump tank. The timer 34 would be then controlled to automatically shut down the pump on a predetermined time basis.

Another possible combination of the components illustrated in FIG. 1 would be the power pack 20 and hydraulic motor 22 operating with an external holding and counter balance brake 42. This could be a one way component, as well. Moreover, these three components could operate in combination with a mechanical over travel stop system 27, but more preferably with a travel limiter with a hydraulic flow blocking valve. This arrangement would operate to close or trigger a switch sending an electrical pulses to a latching relay to thereby cut power to an electrical motor and, hence, flow of hydraulic fluid to the hydraulic motor. Furthermore, the system could also be operated with a flow diverter travel limiter 41 operating in conjunction with a timer 34.

Another possible combination of the components illustrated in FIG. 1 would be the power pack 20 along with a hydraulic motor with internal holding brake 44. On the output of the hydraulic motor would be a hydraulic counter balance brake valve 37 and the travel limiter either with a hydraulic flow diverter valve 41 or other control. It is also possible to use a combination of the travel limiter with the hydraulic flow blocking valve 38. In essence, this system is similar to the combination of the power pack 20, the hydraulic motor 22 and the external holding brake 42 along with a mechanical over travel stop system 27.

The various components in FIG. 1 can also be operated with latching relays 50 and operator control start/stop switches 52, as shown. Moreover, it can be observed that these numerous components, as shown in FIG. 1, can be operated in a variety of combinations. One of the important aspects is to attempt to achieve a power drive at the drive shaft for the cover and a braking mechanism to preclude hard impact of the cover at a fixed end position, along with some mechanism to control the rate of movement of the cover. The combinations, as shown in FIG. 1, can be used to accomplish this result.

The power pack may include a reversible motor, if desired, in order to reverse flow or, otherwise, it can incorporate a directional valve to reverse flow, if desired. In like manner, a pressure transducer switch (not shown) could also be used to break power to a pump forming part of the power pack. Although it is not so illustrated in FIG. 1, an electrical limit switch could be used in place of the encoder 26. Moreover, the encoder limit switch or electrical limit switch could be used to stop movement of the cover drum and, therefore, prevent unwinding of the cover from the drum. In like manner, a mechanical over travel stop system could be employed, if desired. Further, a worm gear reducer can also be used to control unwinding movement of the cover drum.

The latching relays and the operator control switches are used to control operation of the hydraulic motor 22 and, for that matter, the entire drive system. The manually operable operator control switches 52 are preferably operated in combination with latching circuits. In this way, the switch will be automatically held in an open or closed position. When in the closed position, the cover will become unwound from the drum and in the open position, the cover will wind onto a cover drum.

Again, it is possible to use a time-out circuit 34 in conjunction with a pressure diverter valve or pressure relief valve at the power pack. It is also possible to use a pressure relief valve in combination with the hydraulic motor 22 and in combination with the power pack 20. The pressure relief valve, along with a pressure transducer, could be used to break power to the pump forming part of the hydraulic motor drive system after pressure has been built-up to a predetermined pressure level. This would, in turn, cause cessation of the operation of the hydraulic motor 22.

The travel limiters, such as the travel limiter 38 and the travel limiter 41, are described hereinafter in more detail. They are primarily used for controlling the movement of the cover and to prevent a hard impact of the cover at a fixed end position.

BRIEF DESCRIPTION OF COMPONENTS IN FLOWCHART AND OTHER NON-SHOWN COMPONENTS

1. Operator control switches 52. Manually operable operator control switches including a start switch and a stop switch and a type of emergency open switch and which are only manually operable by an operator. These switches may be latching switches or switches which do not latch. Latching circuits can be provided for this purpose.
2. Latching relays 50. Latching relays may be used in combination with the operator control switches and the latching circuits. The latching relays may usually constitute latch and unlatch states for operation of the components being actuated by an electrical signal.
3. Timer 34 (Time-out circuit). A timing circuit to break a control circuit at a pre-set time interval and stop the cover or pump from operating.
4. Pressure relief valve. A hydraulic control valve which will divert pressurized hydraulic flow back to a reservoir at a preset pressure point.
5. Power pack 20. The power pack may be operated with a directional valve or reversible motor to reverse the inlet and outlet pressures of the pump forming part of the power pack. The power pack includes an electrical motor which drives the hydraulic pump to generate flow of hydraulic flow at a certain pressure to activate hydraulic devices such as motors. There are basically two types, one with a directional valve in which the output of the pump is reversed by an external directional valve, and a second type where the electric motor direction and the pump rotational direction is reversed to reverse the input and output flow.
6. Pressure switch or a transducer switch 43. A pressure reading device which sends an electrical signal when it reaches a preset pressure.
7. Electrical limit switch. A mechanical rotary and/or linear device activates electrical type circuit breaking switches at the end of the travel of the device.
8. Encoder device 26. A rotation counting device where travel of a device is limited to a set number of signals from the device and effectively operates as a type of limit switch.
9. Mechanical over-travel stop system 27. An over-travel stop device directly geared and connected or linked to a hydraulic drive system which has sufficient resistance as its adjustable end points of travel to cause a pressure relieving valve device downstream from the hydraulic pump supplying flow to the hydraulic drive motor, to reach its preset bypass pressure position and bypass flow from the motor drive to the reservoir. The over-travel device can also, or in addition to a pressure relief valve, initiate a signal, at a certain preset pressure from a pressure transducing device to the pump electrical circuit to stop the pump.
10. Hydraulic Motor 22. A LSHT (low speed high torque) hydraulic motor powered by hydraulic pressure.
11. Worm gear reducer 24. For use in floating covers these reducers are selected to be inefficient so as to provide self-braking to counteract buoyant force in the floating cover drive.
12. Hydraulic counter-balance valve 37, as shown in FIG. 14. The counter-balance valve is located downstream of the motor to provide a counter-balancing force to the buoyant force when the cover is unwinding.
13. External holding brake 36. A braking device external to the hydraulic motor and connected to the cover drum system to provide a braking action to prevent unwinding of the cover from the drum. The brake may have a one way clutch incorporated so that the brake is adjustable and is engaged in one direction and free-wheels in the opposite direction.
14. Travel limiter 38, 41. Several types of travel limiters are described herein and are designed to control the timing of the rate of movement of the cover, particularly, from the drum to a closed position. The travel limiter operates with an end stop operation, such that a traveling nut engages a fixed end stop in the travel limiter to thereby achieve over pressure in the hydraulic circuit. This will initiate a cessation of flow to the hydraulic motor and stop operation of the cover shaft. The travel limiter could be operated with a flow blocking valve, or otherwise with a diverter valve. The flow blocking valve would stop flow to the hydraulic motor and the diverter valve would divert a flow of fluid to the motor, to a sump or other source.
15. External holding counter balance brake (at least one way) 42. A mechanical disc or shoe brake external to a hydraulic motor and which may be fluid operated or mechanically operated and which provides a one way braking force to a drum shaft. When properly designed, the counter balance brake can serve as a holding brake. The point of frictional force is higher then the kinetic force and, therefore, can be used as a holding brake or a dynamic brake.

16. Hydraulic motor with internal holding brake 44. A hydraulic motor which internally includes its own holding brake built into the motor. In this case, the hydraulic motor with internal brake operates much in the same manner as a hydraulic motor with an external brake. These are usually effective as holding brakes, but cannot be used as dynamic brakes.

DETAILED DESCRIPTION OF PREFERRED EMBODIMENTS

1. Overall System

Referring now to FIGS. 2–4, there is illustrated an overall pool cover system shown in combination with a swimming pool. This pool cover arrangement specifically shows the pool cover mechanism in a subaqueous condition and with a special subterranean compartment, as hereinafter described.

More specifically, there is illustrated a pool deck 70 surrounding a swimming pool wall 72 and which provides an interior swimming pool cavity 74 containing water therein. The automatic pool cover mechanism is located in a separate subterranean compartment 76 formed by a subterranean wall 78, as shown. A pool cover lid 80 is disposed over the compartment 76 and provides access thereto.

A hydraulic drive mechanism 82 is provided for operation of a cover drum 84 and the drive mechanism 82 may be located in a separate compartment 86 (see FIG. 2). The cover drum is located in its own compartment formed by enclosing wall 83. Generally, the hydraulic drive mechanism and braking means 82 is also located in its own separate compartment for easy access for purposes of cleaning and repair. The compartment 86 is formed by a separate enclosing subterranean located wall 88.

By further reference to FIGS. 2 and 4, it can be seen that the cover drum 84 is mounted on a drum shaft 90 which projects through a sealed aperture 91 in the wall 78, and which is also hereinafter described in more detail. A buoyant slat type cover 92 is wound upon the cover drum and may be unrolled therefrom to extend over the upper surface 93 of a swimming pool body of water.

2. Hydraulic Drive Mechanism and Brake Means

The drive mechanism 82 comprises a hydraulic drive motor 94 and is provided with hydraulic hoses 95 and 96 for connection to a suitable hydraulic pump 98 forming part of a power pack 100.

By further reference to FIG. 2, it can be observed that a power pack 100 may be located in its own separate compartment 102 formed by an enclosing wall 104, as shown. However, there is no requirement for installing the power pack in a subterranean environment. The power pack 100 is generally conventional and typically includes, in addition to the pump 98, a suitable electric motor 101 mechanically connected to the pump 98 for operation of same. The remaining details of the power pack are conventional and are therefore neither illustrated nor described herein.

In the embodiment of the invention as shown in FIGS. 2–4, the pump 98 provides fluid under pressure to the inlet hose 95 at the hydraulic motor 94 to cause rotation of same. However, the hydraulic motor is a reversible hydraulic motor to operate in both directions, then it can provide both a driving force for rolling the cover 92 onto the drum 84 and also to serve to operate as a brake to restrain the driving movement of the cover created by buoyancy forces to the closed position.

As the slatted cover is wound onto the cover drum 84, the diameter of the drum increases. The torque on the motor shaft is the product of the upward buoyant force of the slat area unwound from the cover drum and submerged below the surface of the water, multiplied by the instant radius of the cover drum. Consequently, the torque or pressure required from the pumping source must increase as the cover 92 winds up onto the drum 84.

In the unwinding of the cover from the drum 84 and, hence, or covering of the pool direction, the buoyant force inherent in the cover will cause the cover to unwind and cover the pool by itself, without any torque input from the hydraulic motor. To prevent the cover from accelerating and buckling, the hydraulic motor must provide a braking force, to provide a controlled unwinding of the cover from the drum. A low speed, high torque, reversible hydraulic motor of the gerotor type, does not have sufficient internal resistance or braking resistance and will run away with the resultant rotary input derived from the buoyant force of the cover. Therefore a means to brake the cover drum in the unwinding direction is provided to counteract the buoyant force of the cover, as hereinafter described. A one-way brake as described U.S. Pat. No. 5,930,848 may be used for this purpose. This may either be directly coupled to the output shaft or indirectly coupled via a chain drive or other suitable power transmission means.

The drive shaft 90, which is coupled to the hydraulic motor 94, is also provided with a sprocket 110 coupled to a sprocket 112 forming part of a brake mechanism 114. The two sprockets are driven together by means of a drive chain 116, as shown in FIGS. 2 and 5. The sprocket 112 is also connected to and operates in conjunction with a travel limiter 118, hereinafter described in more detail. However, the sprocket 112 is also mounted on a brake shaft 115 which carries a brake disc 117 forming part of a brake mechanism. This braking mechanism may have a brake shoe device 120 to apply a braking pressure to the disc 117. Brake pads (not shown in FIG. 2) engage and provide a frictional braking force against the brake disc 117. As indicated previously, a brake means to brake the cover drum in the unwinding direction was necessary. The brake means 114, as shown, is effective for that purpose.

The advantage of the one way braking means is that a suitable braking force may be tailored for each size of pool width or length or depth of cover roller quite easily. Since the braking force to counteract the buoyant force or gravitational force is only in the unwinding direction of travel, this device only applies the braking force in this one required direction. This is an advantage because if braking force where applied in both directions, the winding force required would be additive, i.e. twice the force or torque in the wind-up direction requiring a higher capacity, considerably more expensive drive system. A further advantage is that the braking force is applied directly to the shaft and thereby constitutes a direct locking of the shaft not subject to creep due to internal leakage inside the hydraulic motor.

An additive advantage of this one way braking system is that this single simple inexpensive device in hydraulic applications greatly simplifies and reduces size and the cost of the drive. The device not only replaces an expensive worm gear reducer, but also reduces the overall cost of the overall drive system. Since the worm gear reducer typically used was required to be highly inefficient to achieve braking force, it was also necessary to increase the required horsepower of the drive and the hydraulic flow capacity of the pump.

Another advantage of the aforesaid one way braking means is that with the braking force set to hold the cover drum stationary in the fully wound-up state (maximum torque on the shaft), it means that the torque that the drive motor must reach at the other completely unwound state, (pool fully covered state) will also be the same torque. To appreciate this, consider that when the cover begins to move from its fully wound up position to that of closing the pool, since the buoyant force just balances the braking force, very little torque is required initially to move the cover. The torque required from the motor however, must increase as the cover unwinds and the radius of the cover drum decreases, and hence the moment arm decreases. (where torque (in. lbs)=radius(moment arm in inches)×force (lbs). At closing only the braking force remains and buoyant force is minimum.

The one way braking system described above is also a distinct advantage when used in conjunction with a hydraulic motor, using a pressure relief valve travel limit system. In such a system the pressure from the hydraulic pressure source is set just high enough to cause the cover to move, and only a slight amount of additional pressure (torque) or resistance will cause the pressure relief valve to relieve or bypass fluid flow and thereby cause the cover to stop. In such a system it is important that the resistance to stop the cover at each end is approximately equal, so that there is not an excessive amount of stress placed on one side of the system stops.

3. Travel Limiter

On flexible membrane safety covers such as described in U.S. Pat. No. 5,184,357 using a dual hydraulic drive and U.S. Pat. No. 5,349,707 using a split stop, the successful and reliable way to consistently have the cover stop at its end position of travel is to use the pressure relief valve to stop the cover. As described in these patents the slider attached to the leading edge is used to positively make contact with the end pulley at the end of the track in the closed position and the split track guide in the fully open position to indicate the end of travel location. The power pack pump has an adjustable pressure relief valve set just high enough to cause the cover to move and relieve or by-pass fluid flow when an excessive resistance is encountered such as the slider body making contact with the track end cap or track guide. This is possible because the cover media is positively pulled by cables in closing the cover and positively opened by a powered covered drum onto which the cover is wound on the opening cycle. In addition the safety cover has structural integrity, and may be placed under some tensile stress. In other words the flexible membrane cover is pulled across the pool by the cables in one direction, and pulled off the pool by the cover drum in the opposite direction.

The slatted or floating cover uses buoyancy or gravitational force which pushes the cover across the pool to close it. The cover is positively removed from the pool by winding the cover onto the cover drum in the opening direction. Typically the slats of these covers have hinges which will not withstand a great deal of tensile stress. Hence the practice has been to use electrical non-contact sensors or electrical rotary limit switches or encoders which count the number of revolutions.

The object therefore is to provide a reliable travel limiting device which does require electrical circuits or wiring. Described herein are several variations of an adjustable device which is geared from the drive train and which has its travel limited by hard positive and adjustable end stops. This device allows a hydraulic circuit to sense a resistance from the increase in pressure. This pressure increases if obtained with a pressure relief valve having been set to bypass fluid flow at a certain preset higher pressure, to relieve flow and thereby stop the cover travel.

Referring to FIGS. 5–8, there is illustrated a first embodiment of a hard stop travel limiting device 170 or so-called "travel limiter" or "travel limiting device". The travel limiting device 170 is designed to provide hard stops representing the equivalent of a stop position for the swimming pool cover at either end of the swimming pool. Thus, instead of the cover banging into an edge of the swimming pool, particularly when it is being closed through the force of buoyancy or gravitational force, the travel limiting device 170 accomplishes hard stops directly in the travel limiting device representing what would have been the hard stops of the cover and thereby prevents any damage to the cover or drive mechanism.

The travel limiting device 170 comprises a cylindrically shaped elongate outer housing 172 and which is hollow forming an interior central bore 174 extending axially therethrough. An end cap 176 is mounted at the left-hand end of the housing 172 and is secured thereto by means of screws 178. In like manner, an end cap 180 is secured to the right-hand end of the housing 172 and is secured thereto by means of screws 182. Extending axially through the housing 172 is a partially threaded shaft 184 containing an acme threaded section 186. A traveling nut 188 or so-called traveler has an internally threaded bore matching the threaded section 186 and, therefore, as the shaft 184 rotates, as hereinafter described, the traveling nut 188 will shift axially along the shaft 184. The nut 188 is constrained from rotating by a pair of keys 190 which are secured to the shaft by screws 192 and which keys 190 fit into key ways 194 formed in the internally threaded bore 174. The set screws 192 are preferably recessed in the manner as shown.

As the shaft 184 rotates, the traveling nut 188 will shift to one end position, such as, for example, a left-hand end position, and will make contact with a face 193 of an adjustable "stop nut" 195, threaded into the end cap 176, in the manner as shown. A lock nut 198 holds the adjustable stop nut in position within the housing. Moreover, by releasing the threaded lock nut 198, it is possible to rotate the adjustable end nut 195 and thereby provide an adjustment of the end position. For this purpose, the stop nut or end nut 195 is provided with an outer knurled finger engaging surface 200.

When the traveling nut 188 or so-called "traveler" reaches the left-hand end position, it will engage an inner surface of the end nut 195. Inasmuch as there is a counter force, the shaft 186 will actually exert a force to the right, reference being made to FIG. 6, and which force will be imposed on the bearing 202. When the shaft 184 is rotated in the opposite direction, the traveling nut 188 will shift to the right and exert a force against annular retaining ring 202 and thrust bearing 206 held in a recessed section of the shaft 184. This will, in turn, stop rotation of the shaft 184. The power pack will sense a pressure increase as a result of the cessation of rotation of the shaft 186 and, hence, the movement of the traveler 188. This pressure increase causes a pressure switch to initiate a current to the coil of a latching circuit to cease operation of the hydraulic motor.

The travel of the traveling nut or so-called "traveler" 188 can be adjusted at the right-hand end of the housing 172 by allowing the outer housing 172 to rotate in housing clamps 208 and 210, as best shown in FIG. 8 of the drawings. When the outer bolts 212 are loosened, the clamps 208 and 210 are released and thereby allow for rotation of the outer housing 172. Accordingly, the body of the device is free, along with the traveling nut, when the latter has engaged an end position. In this way, when a proper end position is achieved, the clamps 208 and 210 can be retightened by tightening the nuts 212.

When the nut 188 abuts the left-hand end position, the nut becomes engaged against that left-hand end wall 176 and the adjustable stop nut 195. This is equivalent to one end position of the cover. When the nut is rotated to the opposite end position and abuts against the end wall, that represents the opposite end position for the movement of the cover.

When it is first desired to use the travel limiting device 170, the cover is allowed to run against a first end position, which may be wound on the drum or fully extended across a swimming pool. At the first end position, the housing 172 is fixed. At the other end position, the nut will then be controlled to abut against the opposite end wall. Adjustment of these positions can be accomplished by shifting the position of the housing and fine tuning adjustment can be accomplished by turning the adjustment nut 196.

In accordance with this construction, it can be seen that the travel limiting device controls the amount of movement of the cover by providing fixed hard end positions for the nut to engage within the housing 172 and which represents the fixed end positions of the cover. Thus, instead of the cover running into an edge of a swimming pool with a hard impact resulting in potential damage to the cover, the travel limiting device represents that movement and controls the movement of the cover.

By further reference to FIG. 6, it can be observed that the sprocket 112, as also shown in FIG. 2, is keyed to an outer end of the shaft 184 extending beyond the housing 172. This sprocket 112 will receive the chain or pulley 116 (not shown in FIG. 6).

In connection with the various combinations of components, as shown in FIG. 1, a one way brake holding mechanism 42 or otherwise a hydraulic motor with internal brake 44, was employed for providing a braking action to the drum shaft, such as the drum shaft 90, when the cover was free floating and was moving to the closed position. One effective means for accomplishing this result is more fully illustrated in FIGS. 5 and 6 and comprises a combination of a one way clutch device 220 as well as a brake mechanism 222. The clutch device 220 includes a braking disc 224 mounted on an outer hub 226 which is, in turn, keyed to an outer end of the rotating shaft 184, as best shown in FIGS. 5 and 6. In this way, when the cable drum rotates in a clockwise direction to move the cover from the pool to the wound position on the drum, the sprocket on the drum shaft will rotate, but the one way clutch is not set to rotate and the brake 222 will remain stationary and inactive, that is, not in a braking condition.

When the drum shaft 90 rotates in the opposite direction, it will thereby rotate the shaft 184 and the one way clutch will now engage and rotate the brake disc 224 causing the latter to rotate.

The braking mechanism 222 comprises a pair of brake pads 228 which are shiftable into and out of engagement by means of a brake arm 230 held by an outer locking nut 232 and which can be biased into engagement by means of a compression spring 234. Thus, when the shaft 184 rotates in that opposite direction, it will cause rotation of the brake disc 224 and the disc will be engaged by the brake pads 228 in the manner as shown in FIG. 6. Moreover, the pads will be held into braking engagement with the disc 224 by the spring 234 to thereby counteract the buoyant force of the cover as it tends to unwind off of the drum in the pool covering direction.

Inasmuch as the travel limiting device is directly coupled to the cover drive train, and the rotational travel is translated to linear travel which can be limited, or otherwise stopped at the end of each reversible rotation, the travel limiting device essentially duplicates the same travel limiting function of the flexible cover hydraulic drive system.

An encoder or electrical limit switch for an electrical drive can effectively accomplish the same result. However, since the electrical components are not desired at or near a swimming pool, the travel limiting device of the present invention accomplishes that function in a relatively safe and highly efficient manner. The advantage of the above-described hard stop travel limiting devices of the invention is that all electrical control can be safely kept away from the swimming pool and also removed from any moisture.

It should be understood that each of the aforesaid travel limiting devices may be coupled to the hydraulic motor either indirectly through the chain drive and sprockets as previously described, or through any other suitable transmission coupling. As a simple example, the hydraulic motor could be coupled directly to the cover drive drum shaft and, at the same time, be connected via a chain and sprocket to the travel limiting device, much in the manner as shown in FIG. 2 of the drawings.

Various types of braking devices can be used. As indicated previously, a brake device is effective to control the speed of movement of the cover, particularly as it moves toward the closed position. The cover would tend to effectively "runaway" and increase its speed to a point where it would run into a closed end position and cause the cover to buckle and even possibly result in damage to the cover. The brake mechanism also effectively operates to maintain the cover at a stopped point. In this respect, the brake mechanism operates in conjunction with the travel limiter device.

One effective brake mechanism which can be used is that which operates with an overrunning one way clutch. One type of conventional overrunning one way clutch is a sprague type overrunning one way clutch 290, which is more fully illustrated in FIGS. 9–11 of the drawings. Sprag overrunning clutches 290 typically include a sprag cage 292 for maintaining orientation of a plurality of spragues 294 in concentricity between an outer cylindrical engagement raceway 296 and an inner cylindrical engagement raceway 298. The inner engagement raceway 298 typically comprises or otherwise engages the surface of a shaft 300 which would be in the pool cover drive. As indicated by the arrows in FIG. 14, relative rotation between the respective inner and outer raceways 296 and 298 in one direction rotates the spragues 294 into wedging engagement between the respective raceways coupling the rotation of one raceway to the other raceway. Relative rotation of the respective raceways 296 and 298 in the opposite direction as indicated by the arrow in FIG. 11 rotates the spragues out of engagement with the respective raceways de-coupling rotation of the raceways allowing the outer raceway to overrun. Such sprag type overrunning clutch mechanisms may also include ball and/or needle bearings confined by the sprag cage 292 to facilitate overrunning rotation of the respective raceways.

It is also possible to use a Torrington type roller clutch to transmit torque between a shaft and a housing in one direction and allows free overrun in the opposite direction.

4. Hydraulic Power Pack Shut-Off

Floating covers move very slowly across the pool surface so as to avoid buckling when the pool is being covered. Consequently the time to open or close the cover may take three to four minutes depending on the size of the pool.

Since this type of cover is usually not a safety cover, there is usually no need to have the operator at the switch for the full cycle. Typically a latching circuit is used whereby the operator will simply push a button to start the cover moving and the rest is automatic. In the case where the cover drive is stopped by activation of the pressure relief valve means must be provided to stop the pump from running after the travel limit has been activated. Two simple solutions are provided. The first consists of the power pack or pump and motor furnished with a pressure relief valve and also a pressure switch. The pressure switch is calibrated to send an electrical signal to the control circuit which can be made to break the electrical circuit to the pump motor and stop the pump. It is possible to also use this pressure transducer so long as it has a means for adjusting for pressure. Another means is to provide the control switch circuit with a simple timing device. This device is adjusted to shut off current to the pump after the cover has stopped by pressure relief or flow diversion to a tank. Typically, one would set the timer to allow for a four to five seconds delay after the cover has stopped.

5. Control Systems

FIGS. 12–14 illustrate several control systems which may be used with the travel limiting mechanisms and the automatic pool cover system of the invention. Referring to FIG. 12, a broken line, designated by reference numeral 310, separates a power pack 312 from the hydraulic drive section 314 of an automatic pool cover system in accordance with the present invention. In essence, all of the electrical components are located within the power pack 312 or at least associated with the power pack 312 in a position remote from a swimming pool. The hydraulic drive system 314 is located at or in close proximity to a cover drum which holds the cover for the swimming pool.

When it is desired to start operation and to either open or close the swimming pool cover, the operator will actuate either a close switch 314 or an open switch 316, as shown in FIG. 12. Actuation of the open switch 316 will cause a current flow to a latching relay designated as 318, thereby closing the latch. This closed latch will thereupon allow a current flow to a relay 320 and thereby start the rotation of a reversible electric motor 322. This motor 322 is coupled mechanically by a mechanical link schematically designated as 324 in FIG. 12 to a reversible hydraulic pump 326. This combination of the electric motor 322 and the hydraulic pump 326 are frequently referred to as "the hydraulic power pack".

It should also be recognized that it is possible to use a single directional electric motor and pump with a directional control valve to change the direction of the flow from the pump 326. For this purpose, a directional valve with solenoids would be used.

In the arrangement as shown in FIG. 12, when the start switch 316 has been actuated, hydraulic fluid under pressure will flow from the power pack through a pressure switch 328. Another pressure switch 330, operating in conjunction with the pressure switch 328, also has its set point pressure above the normal pool cover operating pressure. Therefore, pressurized fluid flows to a hydraulic brake motor 332. The brake motor 332 preferably has an internal mechanical brake retained by spring pressure and which is releasable when hydraulic motor pressure is applied to the motor. However, the motor will not begin to rotate until there is sufficient pressure to release the brake of that motor and, secondly, a higher pressure is achieved in a pilot pressure line 334 to open a counter balance valve 336. The pilot pressure on the motor, which is actually a back pressure, is set sufficiently high to counteract the buoyant force of the pool cover as it unwinds to cover the pool.

It is well recognized that manufacturers of hydraulic brake motors frequently recommend that the brake be used only as a holding brake. However, with the arrangement of the present invention, it is desirable to set the counter balance valve pilot line pressure, that is, the pressure in the line 334, well above the brake release pressure. Therefore, as the hydraulic motor 326 is mechanically coupled to a travel limiting device, such as a travel limiting device 338, as shown in FIG. 16, it will continue to move the mechanical traveling nut 340 of that travel limiting device until it reaches an end position of travel. At this point, the hydraulic motor 326 will sense the high resistance and the pressure will build until it reaches the set point pressure of the pressure valve 328. This will then close the normally open switch and send a current to an unlatching side of another relay 340, as also shown in FIG. 12. This will, in turn, brake the circuit to the relay 320 to stop current flow to the electric motor 322 and, hence, stop operation of the pump 326.

A check valve 335 across the pressure valve 336 allows the brake 332 to be open in the wind-up direction of the pool cover. The check valve 335 will allow flow in the opposite direction. Even minimal flow is desirable to enable the nut to start moving again. Otherwise, there would be no force sufficient to start movement of the nut 340 after it stopped. Further, it may be desirable to add a cross-piloted load check circuit on the output side of the power pack to assist in preventing rotation of the hydraulic motor 326 when at rest.

It can also be observed that the operator can also push an emergency stop switch 342 at any point during travel of the cover in order to immediately stop the cover. Actuation of this emergency stop switch 342 will send current to the unlatching side of either of the relays 318 or 340, thereby breaking the electric circuit to the power pack and, particularly, to the electric motor 322. A relay switch 344 also operates in conjunction with the relay switch 320 and on the opposite side of the electric motor 322 with respect to the relay switch 320. A latching or unlatching of the latching relay 318 would allow the relay 344 to close and thereby cause operation of the motor 322 in the opposite direction.

It can be observed that the hydraulic motor 322 will drive in each of the directions, that is, the covering direction and the wind-up direction. The hydraulic motor effectively does not effectively provide any braking action when the cover is being moved to the closed position, that is, extending across the swimming pool. The hydraulic motor primarily operates to wind the cover onto the cover drum. In the operation of the hydraulic system and the hydraulic motor in particular, it is desirable to set the lock pressure point to offset the buoyancy forces moving the cover. This will allow the motor to continue to operate without any so-called "run away". In essence, the motor is working against the counter balance pressure. Since the hydraulic motor thereby overcomes the counter balance forces, it can move the cover in a controlled fashion.

It can be observed that the travel limiting means 338 operates in the same manner as each of the previously described travel limiting means, in that when the nut 340 reaches an end position, it will cause an end position engagement and thereby physically cause the motor 322 to stop. The motor will effectively stop because of the resistance to travel created by the travel limiting means 338. In effect, the power pack will reach the relief pressure on the pressure switches 320 and 330.

FIG. 13 is a schematic illustration of a control circuit similar to FIG. 12. In this respect, like components described in FIG. 12 will carry the same reference numerals as their corresponding components in FIG. 13.

This circuit arrangement of FIG. 13 is similar to that of FIG. 12, except that the counter balance valve 336 of FIG. 12 has been replaced by a one way braking device 350, as shown in FIG. 13. This braking device 350 is mechanically coupled to the hydraulic motor 332 by means of a mechanical linkage 352, as shown in FIG. 13. In the embodiment as illustrated, the braking device 350 comprises a ratchet 354 and a pawl 356 which allows only one way rotation of the brake mechanism coupled to the hydraulic motor 332. In the embodiment as shown, the ratchet 354 can only operate freely in the counter-clockwise direction but would be precluded from rotation in the clockwise direction, unless the pawl 356 was released.

It should be recognized that the ratchet and pawl arrangement, as illustrated in FIG. 13, is only one of numerous one way brake devices which would be used. This device is effective in the circuit arrangement as shown on medium sized pool covers. It can also serve as a holding brake to prevent rotation of the cover drum when at rest. Due to the fact that a larger force is required to brake the cover drum at rest, this type of dual stage frictional force is advantageous in this particular arrangement. It should also be understood that the braking mechanism which is used can be incorporated directly in the hydraulic motor 332 or it can be provided as a separate braking mechanism in the manner as shown.

A travel limiting device using a mechanical hard stop is usually quite sufficient to stop rotation of a hydraulically operated floating pool cover of a normal size, that is, for example, approximately ten meters wide by twenty meters long and with a rotational speed of four to five revolutions per minute. However, in very large floating pool covers, the initial force which can be produced into a mechanical hard stop for stopping the cover may be too large and cause the device to jam.

Another version of a hydraulic system which can be used for this purpose is that hydraulic system 360 as illustrated in FIG. 14. In this case, the arrangement of the circuit is similar to that of FIG. 12. However, a mechanical two way—two position hydraulic valve 364 is used and is hydraulically interposed between the travel limiting device and the power pack 312. In this embodiment, the travel limiter 338 does not actually provide for a jamming of the traveling nut 340. Rather, the traveling nut 340 is provided with a probe or upstanding actuating element 366 for activating a plunger 368 on the hydraulic valve 362 or otherwise a plunger 370 on the hydraulic valve 364.

By further reference to FIG. 14, it can be observed that the valve 362 and the valve 364 each has a check valve position 372, and each of which would block flow of hydraulic fluid to the hydraulic motor 332. In like manner, each of the valves 362 and 364 would be normally biased to a normal flow position, that is, positions 374 and 376, respectively, allowing normal flow of hydraulic fluid to the motor 332. In effect, this arrangement constitutes a bypass shut-off circuit around the two position valve 364.

When either of the valves 362 or 364 are in the check valve position, they will almost instantaneously build up pressure to either of the pressure switches 330 or 328 causing these pressure switches to reach a set point and trigger the unlatching side of the latching relays 318 and 340. This will, in turn, stop power from the power pack to the cover. Thus, the cover can now move in the opposite or reverse direction, since the valves 362 and 364 allow flow in the normal flow position, that is, in a direction opposite to that of the check valve. This occurs while the valve is being held in position initially until the valve is shifted back to a two way flow position by the traveling nut 340 moving in an opposite direction.

It can be observed that use of these pressure switches for stopping operation of the hydraulic motor 332 allows the set point pressure to be used as a fine adjustment for the travel limiting device. Thus, the set point pressure may be set slightly higher or lower to fine tune the travel.

Referring now to FIG. 15, there is illustrated another form of travel limiting control mechanism which will control movement of the cover when moving both to the open and closed positions. For better appreciation of the control circuit of FIG. 19, reference can also be made to FIG. 2 showing an overall schematic illustration of the components forming part of the automatic pool cover system of the invention. In this particular case, like reference numerals will be used with respect to the previously described embodiments of the invention to designate like components.

Referring again in more detail to FIG. 15, it can be observed that the slated pool cover 92 is mounted on the drum 84 and which is, in turn, supported on a drum shaft 90. However, in place of the drive system as shown in FIG. 2, the hydraulic motor 94 is connected to a worm gear reducer 384 of generally conventional construction in the manner as shown. The hydraulic motor 94 similarly receives the hydraulic hoses 95 and 96, as shown. The worm gear reducer has an input shaft 386 which is connected through a coupling 388 to a input shaft 390 of a limit switch actuator 392, and the latter of which is hereinafter described in more detail.

Also by reference to FIG. 15, it can be observed that the hydraulic lines 95 and 96, which are used for operation of the hydraulic motor 94, are connected to the limit switch actuator 392 and which, in turn, receives the hydraulic fluid through alternate fluid supply and return lines 394 and 396, as shown.

Turning now to FIGS. 16 and 17, the mechanical limit switch actuator is more fully illustrated in detail. It should be noted that the mechanical limit switch actuator 392 carries many of the details of construction of a device for limiting rotation of a rotating shaft, as set forth in U.S. Pat. No. 3,718,295, dated Feb. 27, 1973, to Mimeur. However, the device of the present invention is a valve operated limit switch actuator and which uses electrical limit switches in combination with the hydraulic valves 362 and 364. Thus, and to this extent, the arrangement as shown in FIGS. 15–17 is still a further improvement over the arrangement as shown in FIG. 14, although both are quite viable in the present invention.

The mechanical limit switch actuators 392 operate in a manner quite similar to that described in the aforesaid U.S. Pat. No. 3,718,295 to Mimeur, except that in this case, electrical limit switches of Mimeur are not employed. Rather, the valves and associated valve operating members are used in place thereof. Moreover, the electric motor in the Mimeur patent is obviously not used.

In the embodiment of the invention as shown in FIG. 15, the reducer is a hollow shaft type reducer and the cover drive shaft effectively passes directly through the reducer and thereby connects to the coupling 388 and the shaft 390 of the limit switch actuator 392. This combination effectively operates as a replacement for a one way brake system or otherwise the use of the combination of a holding brake with counter balance valve arrangement by using the worm gear reducer. The limit switch actuator is coupled directly with the drum shaft so as to not unduly lengthen the travel required for the limit switch actuator. In this case, the worm gear reducer would preferably have a reduction at a ratio of about fifteen to one or even higher to achieve the necessary adequate inefficiency and braking resistive force.

The mechanical limit switch actuators of the invention as shown in FIGS. 16 and 17 generally comprises non-rotatable screw shafts 400 and 402, as shown. However, each of the screw shafts 400 and 402 are provided with opposite hand screw threads, as best shown in FIGS. 16 and 17. There is also provided a rotatable splined drive shaft 404 which has a reduced end shaft 405 connected to the coupling 388 and which is, in turn, connected to the gear reducer output 386. The screw shafts 400 and 402 engage with opposite end plates 406 and 408 which support the screw shafts 400 and 402.

When the splined shaft rotates, it will cause the nuts 410 and 412 to move along the stationary screw shafts 400 and 402, respectively, due to the threaded engagement therebetween. As the splined shaft 404 rotates, the two nuts 410 and 412 will rotate in the same direction. However, because the screw shafts 400 and 402 have opposite threads, the nuts 410 and 412 will move to the opposite ends of the screws 400 and 402. Thus, the mechanical limit switch actuator operates in response to rotation of the drum shaft and the motor drive shaft. It should also be recognized that in place of a direct connection, a mechanical drive chain and sprockets or the equivalent could be used for connection to the drum shaft.

The traveling nuts 410 and 412 are limited at the ends of travel by unthreaded portions 415 and 417, as shown in FIGS. 16 and 17. Thus, when the traveling nuts 410 and 412 reach the ends of the screws, they will effectively free-wheel on the ends of the screws 400 and 402 in a manner as hereinafter described.

The nuts 410 and 412 actually operate as types of switches. In this case, valve actuator arms 414 and 416 are mounted on the ends of the threaded shafts 400 and 402 and will similarly engage valve stems 420 and 422 on the respective valves 362 and 364. Thus, when the actuator arms 414 and 416 engage the respective valve stems 420 and 422, they will open check valves 424 and 426, respectively, against the action of springs 440 and 442, also as shown in FIGS. 16 and 17.

When one nut 410 reaches its right-hand end point position, it slidably shifts the arm 414 to the right, as shown in FIG. 21, and this allows the check valve 424 to literally close and thereby block flow. This causes a pressure increase in the line from the power pack causing actuation of the pressure switch. In this way, the spring loaded ball of the check valve literally operates as a one way check valve. The check valve 335 allows for a short interval of motion for the nut 410 and 412 which causes a sufficient bypass to start movement.

The limit switch actuator of the invention is effectively fail safe. Each of the threaded screws 400 and 402 have unthreaded end sections 416 and 417 at each of the opposite ends. In this way, if the splined shaft 404 should keep rotating, the nuts would reach the unthreaded ends of the shafts 416 and 417 and thereby free-wheel on the ends of the shafts. Thus, no damage would result to the swimming pool cover. The springs 444 and 446 on one end and 440 and 442 on the opposite end would bias the nuts back onto the threaded portions of the shaft when the splined shaft again starts rotating. Even though the splined shaft, and even the pinions, may continue to rotate, there will be no damage to the device if the valve should fail to block fluid flow. As the splined shaft continues to rotate in the opposite direction, the nut 410 will move to the left and is urged by the strength of the spring 444 back against the shoulder of the left-hand threaded section of the shaft. A similar spring 446 is also provided on the opposite screw.

It can be observed that the embodiment as shown in FIG. 14 effectively represents a more simplistic mechanical limit switch device than that illustrated in FIGS. 17 and 18, but both effectively operate with an equivalent function. However, it can be observed that the mechanical switch actuator, as shown, in combination with the hydraulic valves and where flow is blocked at an end point, is quite unique. The pressure switch would send a signal to a latching relay to thereby stop the operation of the pump.

The various screws on the screw shafts 400 and 402 are generally angularly fixed. However, they can be turned manually, if desired, by means of gears 450 and 452 mounted on the ends of each of the screw shafts 400 and 402, as shown in FIGS. 20 and 21. Thus, the distance between each of the respective traveling nuts 410 and 412 and, hence, the arms 414 and 416, can thereby be slightly adjusted.

Normally, the initial setting of each of the end positions for movement of the traveler, which is effectively operating as a type of limit switch, results from a trial and error situation. With the device situated next to a swimming pool, it is relatively inaccessible and, particularly, inconvenient to attempt to adjust. With a trial and error situation, the operator must necessarily continuously adjust the threaded rods 400 and 402 in order to allow the traveling nuts 410 and 412 to stop in the right position, that is, timed to shut off at the exact points.

Two bypass circuits 471 and 473 along with logic valves 470 and 472, respectively, allow the user of the system to initially set the limit switch to cut off early and thereby activate the arms 414 and 416 to close the valves 362 and 364. At this point, the user would then have to open the bypass valves 362 and 364 to allow the cover to manually continue to reach the end position. At this point, the nut 410 has been driven to the non-threaded section 415 for free-wheeling and held against the thread by means of one of the springs 440 or 444. The user would then be forced to stop the cover by using the emergency stop switch. The user would then close the logic valve and allow the valve 362 to pick up the end stop automatically in the next operation of the cover. In accordance with this system, there is provided a type hydraulic control circuit in which the circuit is self-programming so as to properly stop the cover in the next cycle.

It is possible to also use a hydraulic motor, such as the motor 332, in the form of a regular dual rotation motor in place of a motor with an internal holding brake, such as the type illustrated in FIG. 14. This arrangement would use a ratchet and pawl operating as a type of one way clutch in place of the hydraulic motor and the holding brake. In this case, the pool cover 92 is unspooled from a cover drum, such as the drum 84, and the latter of which is mounted on a drum shaft 90. A ratchet 460 is mounted on the drum shaft 90, in the manner as best shown in FIG. 18 of the drawings. A pawl 462 is spring biased to be engaged against the ratchet when the system is not pressurized with hydraulic fluid and to become disengaged when the pressure is delivered to the hydraulic motor. A spring 464 biases the pawl to be engaged with the ratchet, in the manner as illustrated in FIG. 18.

A hydraulic cylinder 466 is also provided to act upon the pawl 462 and is supplied with hydraulic fluid under pressure by means of a hydraulic line 468. Hydraulic fluid under pressure would be delivered to the cylinder 466 when the cover is unwinding from the cover drum, that is, in the clockwise direction, reference being made to FIG. 18. This would permit disengagement of the pawl from the ratchet 460. It can be observed that the pawl actually pushes against a plunger 470 inside of the hydraulic cylinder 466 and, thus, opposes the action of the pawl lever 462 pivoting on a pivot pin 472.

When the system has reached a stop position, the pressure in the cylinder 466 effectively drops and the spring 464 pushes against the pawl 462 to engage against the ratchet 460. This will effectively lock the pool cover from turning in the clockwise direction. The ratchet and pawl arrangement also overcomes the hydraulic motor internal leakage and would preclude any creep therefrom.

Thus, there has been illustrated a unique and novel automatic cover system for slat-type buoyant covers and which provides for winding or unwinding control or both over a pool cover. The present invention therefore fulfills and meets the various objects which have been sought therefor. It should be understood that any changes, modifications, variations and other uses and applications will become apparent to those skilled in the art after considering the specification and the accompanying drawings. Therefore, any and all such changes, modifications, variations and other uses and applications are deemed to be covered by the invention.

Having thus described the invention, what I desire to claim and secure by Letters Patent is:

1. A pool cover system for operating a buoyant cover and where the cover is controlled in at least closing movements of said cover relative to a swimming pool, said pool cover system comprising:

a) a rotatable cover drum for winding a buoyant cover comprised of at least one buoyant panel onto said drum and allowing the force of gravity or buoyancy acting upon said tool cover to cause an unwinding of the cover from the drum to a closed position so that the cover may extend across and cover the swimming pool;

b) a fluid motor for causing driving movement of the cover drum allowing the pool cover to move across a swimming pool to an open position with winding of the cover onto the cover drum; and c) a travel limiting means for controlling the limits of movement of the cover and stopping movement of the cover through the action of a fluid pressure differential which is generated when the cover has reached a closed position to preclude further movement of the cover at the closed position, and electrical means operable in response to said fluid pressure differential to initiate an electrical response and stop rotation of said drum when the cover reaches the closed position.

2. The pool cover system of claim 1 further characterized that said fluid motor is operated by an electrical power pack remote from the hydraulic motor and from the swimming pool and said electrical response occurs in association with said electrical power pack.

3. The pool cover system of claim 1 further characterized in that said cover drum is located in a position where it is submerged in water and buoyant forces act upon the cover wound upon said drum to cause an unwinding thereof such that a positive driving force to move the cover to the closed position would not necessarily be required, and said movement control means controls movement resulting from the tendency of the cover to unwind from said cover drum.

4. The pool cover system of claim 3 further characterized in that said fluid motor provides a positive driving action for moving the cover to the opened position when winding the pool cover about the drum, but operating in conjunction with a braking means to provide a braking action when the cover is unwinding from the drum to thereby restrain tendency of the cover to unwind from the drum.

5. The pool cover system of claim 3 further characterized in that said travel limiting means comprises a mechanically actuated limit switch.

6. The pool cover system of claim 3 further characterized in that said fluid motor is a hydraulic motor, said pool cover system comprises a hydraulic pump, and said travel limiting means comprises a pressure sensitive device responsive to said pressure differential.

7. The pool cover system of claim 1 further characterized in that said fluid pressure differential is generated in a fluid pressure line associated with supplying fluid under pressure to said fluid motor and activates a fluid pressure switch in response thereto.

8. A pool cover system for operating a buoyant swimming pool cover comprised of at least one buoyant panel and for moving same across a swimming pool to a closed position where the cover extends over the swimming pool and back to an opened position, said automatic pool cover system comprising:

a) a cover drum upon which the buoyant swimming pool cover is wound thereon to allow the swimming pool to be in an opened condition and which allows for unwinding from the drum to cover the swimming pool;

b) a fluid drive motor operatively connected to said drum for rotating same and causing a winding of the pool cover onto the drum when opening the swimming pool;

c) an electrically operated power pack in a position remote from said pool cover and said fluid drive motor to provide a fluid driving force for operating said fluid drive motor;

d) fluid line means carrying fluid supplied to the fluid drive motor and connected between said power pack and said fluid drive motor, such that said pool cover system can operate with said cover drum being subaqueously located or elevated, thereby electrically insulating the power pack from the fluid drive motor and thereby eliminating any electrical hazard at or in proximity to the swimming pool; and e) pressure responsive means operable in response to pressure of fluid in the fluid line means such that the system provides control over a limit of movement of the cover.

9. The pool cover system of claim 8 further characterized in that said fluid motor is a hydraulic motor and said fluid line means carries hydraulic fluid, and said power pack includes a hydraulic pump in proximity to said electric motor for operation by said electric motor.

10. The pool cover system of claim 8 further characterized in that said drum is mounted on a drum shaft powered for rotation by said fluid drive motor in at least the wind-up direction to wind the pool cover onto the drum, and a brake means is operable with respect to said shaft when said pool cover is being unwound from said drum allowing the cover to move to the closed position.

11. The pool cover system of claim 10 further characterized in that said pressure responsive means comprises travel limiting means which is operatively connected to said drum shaft and provides control for the end of travel positions of the pool cover in both the opened and the closed positions to thereby preclude an overwinding or unwinding of the cover at the closed or opened positions.

12. The pool cover system of claim 11 further characterized in that said travel limiting means has a traveler rotatable shaft and a traveler shiftable on said shaft in response to and proportional to rotation of said drum, such that the traveler moves for a distance proportional to the distance of movement of the cover.

13. The pool cover system of claim 12 further characterized in that said drum is mounted for rotation on a drum shaft, and means couples the traveler shaft of said travel limiting device to the drum shaft, such that when the traveler reaches an end position, it will result in an action which causes the sending of a signal to an electrical circuit arrangement and which circuit arrangement will operate to stop movement of the drum shaft.

14. The pool cover system of claim 13 further characterized in that said travel limiting means comprises said fluid pressure switch.

15. The pool cover system of claim 14 further characterized in that said travel limiting means comprises a traveler element moving in response to rotation of the drum between a pair of traveler end positions.

16. The pool cover system of claim 8 further characterized in that said pool cover system comprises an electrical circuit arrangement operatively connected to the pressure responsive means and operable in response to a pressure differential with respect to the fluid line means for controlling rotation of said cover drum and thereby controlling movement of said cover to preclude over-unwinding of said cover.

17. The pool cover system of claim 8 further characterized in that said drum is mounted on a drum shaft powered for rotation by said fluid drive motor in at least the wind-up direction to wind the pool cover onto the drum.

18. The pool cover system of claim 8 further characterized in that said pressure responsive means is operatively connected to a travel limiting device associated with said drum and provides control for the end of travel positions of the pool cover in both the opened and the closed positions to thereby preclude an overwinding or over-unwinding of the cover from the drum at the closed or opened positions.

19. The pool cover system of claim 18 further characterized in that said travel limiting device has a traveler rotatable shaft and a travel limiter element is shiftable on said rotatable shaft in response to and proportional to rotation of said drum, such that the travel limiter element moves for a distance proportional to the distance of movement of the cover.

20. The pool cover system of claim 19 further characterized in that when the travel limiter element reaches an end position, it will result in an action which causes the sending of a signal to an electrical circuit arrangement operatively connected to said pressure responsive means and which circuit arrangement will operate to stop movement of the drum.

21. A pool cover system for moving a swimming pool cover comprised of at least one buoyant panel to a closed position where the cover extends over a swimming pool and back from the closed position to an open position where the cover is wound upon a cover drum, said pool cover system comprising:

a) a drum for winding the cover onto the drum when the cover is being moved to the opened position allowing access to the swimming pool;

b) fluid operated motive means for causing rotation of the drum to wind the cover onto the drum; and c) one-way brake means for providing a braking action which controls the speed of movement of the cover from the fully opened position where the cover is wound upon the drum to the closed position when the cover is moving across the swimming pool, and which brake means operates in a first mode to provide no braking action and no braking force is applied to the drum or to the pool cover when the motive means is rotating the cover drum to wind the cover on the drum bringing the cover to the opened position, said brake means also being operable in a second mode to provide a positive braking action to control and limit the rate of movement of the cover unwinding from the drum when the cover is moving to the closed position and which would otherwise move uncontrolled toward the closed position as a result of buoyant forces or the force of gravity acting upon the pool cover, such that any braking force is applied in one direction only and only when the cover is moving from the opened position to the closed position and no braking force is applied when the cover is moving from the closed position to the opened position.

22. The pool cover system of claim 21 further characterized in that said brake means comprises a drive ratio brake operating in conjunction with a travel limiting device which controls the end of travel positions of the pool cover.

23. The pool cover system of claim 21 further characterized in that the pool cover system comprises a rotary shaft travel limiter with a mechanically engageable traveling element.

24. The pool cover system of claim 21 further characterized in that said motive means comprises a hydraulic motor which is coupled to the cover drum for rotating same to wind the cover onto the drum, and the pool cover system comprises an electrically operated power pack at a remote site for supplying hydraulic pressure to operate the hydraulic motor, and a pressure relief valve located at the remote power pack and operating in conjunction with the hydraulic motor to enable a bypassing of pressure to the hydraulic motor to provide for a braking action.

25. The pool cover system of claim 21 further characterized in that said pool cover system comprises a travel limiting device for limiting rotation of the drum in response to a fluid pressure condition when the cover is unwinding from the drum and reaches the closed position to thereby preclude an over-unwinding of the cover from the drum thereat.

26. In an automatic cover system providing for winding a cover upon a drum from a fully closed position to a fully opened position and allowing for unwinding of the cover from the drum for movement to a fully closed position, an improvement comprising a travel limiting arrangement for controlling movement of the cover so that it does not excessively unwind from the drum when the cover reaches at least the closed position, said travel limiting arrangement having a travel limiter element moving a travel limiting distance between two travel limiting end positions on the travel limiting arrangement and where movement of the travel limiter element for a travel limiting distance is representative of a distance of movement of the cover between the opened and closed end positions of the cover, said traveler limiter element engaging with travel limiting end positions when the cover reaches its opened or closed end positions of movement, fluid control means associated with the travel limiter end positions and engageable by the travel limiter element and operable to provide a fluid pressure condition to control movement of the cover, thereby precluding any over-winding or over-unwinding of the cover at either of the fully opened position or fully closed position.

27. The improvement in the pool cover system of claim 26 further characterized in that the travel limiting arrangement also comprises an electrical circuit arrangement operatively connected to the fluid control means for controlling rotation of the cover and stopping movement of the cover at a closed end position.

28. A method of operating a swimming pool cover comprised of at least one buoyant panel which is capable of extending to a closed position over a swimming pool and to an opened position where it is wound upon a cover drum, said method comprising:

a) providing a rotating power to said cover drum for rotating same at least in a wind-up direction to rotate the pool cover about the drum and which is powered for rotation only from a fluid driving source at or in proximity to said swimming pool;

b) moving a traveler element of a travel limiting assembly in proportion to the movement of the drum;

c) generating a fluid pressure condition when the traveler element reaches a first limit of travel at the closed position; and d) converting that pressure condition into an electrical action at a position remote to the swimming pool to stop rotating power to the cover drum, to thereby preclude over unwinding of the cover from the drum at such closed position.

29. The method of claim 28 further characterized in that said method comprises providing fluid under pressure to a fluid motor located at or in proximity to said drum and which causes rotation of said drum, said fluid motor being operated by the fluid under pressure and which fluid is driven under pressure from an electrically operated power source at a remote location.

30. A pool cover system for operating a buoyant cover and where the cover is controlled in at least closing movement relative to a swimming pool, said pool cover system comprising:

a) a rotatable cover drum for winding a buoyant cover onto said drum thereby moving said cover to an opened position and allowing unwinding of the cover from the drum for movement to a closed position so that the cover may extend across and cover the swimming pool;

b) a fluid drive motor for operating the cover drum and winding the cover onto the cover drum thereby causing an opening movement of the pool cover across the swimming pool to an open position;

c) an electrically operated power assembly for causing operation of said fluid drive motor;

d) means for detecting the presence of the cover when the cover moves to or near the closed position and causing generation of a pressure condition in response thereto; and e) an electrical circuit arrangement for causing generation of a responsive electrical action in response to the generated pressure condition and causing the responsive electrical action to abate operation of the fluid motor by the power assembly.

31. The pool cover system of claim 30 further characterized in that said cover is controlled in both opening and closing movements to prevent over-winding or over-unwinding at the opened and closed positions.

32. The pool cover system of claim 30 further characterized in that the pressure condition is a change in fluid pressure generated in a fluid line connected to said fluid drive motor.

33. The pool cover system of claim 32 further characterized in that the electrical circuit arrangement comprises an electrical latching circuit and the responsive action to the pressure condition is the generation of an electrical signal.

34. The pool cover system of claim 30 further characterized in that said electrical circuit arrangement is associated with the electrically operated power assembly and is remote from the fluid drive motor and from the swimming pool.

35. The pool cover system of claim 30 further characterized in that said cover drum is located in a position where it is submerged in water and buoyant or gravitational forces act upon the cover when wound upon said drum to cause an unwinding thereof, and a brake means forms part of said system to control movement of the cover to the closed position resulting from the tendency of the cover to unwind from said cover drum as a result of buoyant forces or gravitational forces.

36. The pool cover system of claim 30 further characterized in that said cover drum is located in an elevated position where it is above the surface of the water in the swimming pool and gravitational forces tend to cause an unwinding of the cover from the drum to cause an unwinding thereof, and a brake means forms part of said system to control movement of the cover to the closed position resulting from the tendency of the cover to unwind from the drum as a result of gravitational forces.

37. The pool cover system of claim 32 further comprising:

a) a travel limiting housing;

b) a travel limiter shaft arrangement extending through said housing;

c) a traveler element movable on said travel limiter shaft arrangement and translating movement therealong in response to relative rotation between said transfer shaft arrangement and said traveler element;

d) a first fixed contact element in said travel limiting device housing representing one end position of travel of the pool cover and which traveler element contacts the first fixed contact element when the cover reaches a first end position of travel across the swimming pool; and e) a second fixed contact element in said housing representing an opposite end position of travel of the pool cover and which traveler element contacts the second fixed contact element substantially with the cover reaching a second end position of travel across the swimming pool.

38. The automatic pool cover system of claim 37 further characterized in that said traveler element translates axially along said shaft through threaded engagement of said traveler element with said travel limiter shaft and which is keyed with respect to said housing to preclude rotation of said traveler element.

39. The travel limiting device of claim 37 further characterized in that adjustment means is provided for adjusting the first and second end positions of the traveler element to coincide with the respective end positions of movement of the pool cover.

40. A pool cover system for operating a buoyant cover and where the cover is controlled in at least closing movements of said cover relative to a swimming pool, said pool cover system comprising:

a) a rotatable cover drum for winding a buoyant cover comprised of at least one buoyant panel onto said drum and allowing the force of gravity or buoyance to cause an unwinding of the cover from the drum to a closed position so that the cover may extend across and cover the swimming pool;

b) a fluid motor for causing driving movement of the cover drum allowing the pool cover to move across a swimming pool to an open position with winding of the cover onto the cover drum;

c) a travel limiting means for controlling the limits of movement of the cover and stopping movement of the cover through the action of a fluid pressure differential which is generated when the cover has reached a closed position to preclude further movement of the cover at the closed position, and electrical means operable in response to said fluid pressure differential to initiate an electrical response and stop rotation of said drum when the cover reaches the closed position; and d) movement control means operatively associated with said cover drum to control a rate of movement of the cover from the cover drum during extension of the cover over a swimming pool.

41. The pool cover system of claim 40 further characterized in that the movement control means comprises a worm gear drive.

* * * * *